US006583718B2

(12) United States Patent
Curran et al.

(10) Patent No.: US 6,583,718 B2
(45) **Date of Patent: *Jun. 24, 2003**

(54) APPARATUS AND METHOD FOR SYNCHRONIZING VISUAL/AUDIBLE ALARM UNITS IN AN ALARM SYSTEM

(75) Inventors: John W. Curran, Lebanon, NJ (US); Joseph Kosich, S. Toms River, NJ (US)

(73) Assignee: Wheelock, Inc., Long Branch, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/119,229

(22) Filed: Apr. 9, 2002

(65) Prior Publication Data

US 2002/0149478 A1 Oct. 17, 2002

Related U.S. Application Data

(60) Continuation of application No. 09/793,215, filed on Feb. 26, 2001, now Pat. No. 6,369,696, which is a continuation of application No. 09/153,105, filed on Sep. 15, 1998, now Pat. No. 6,194,994, which is a continuation-in-part of application No. 09/074,328, filed on May 7, 1998, now Pat. No. 5,982,275, which is a continuation of application No. 08/807,063, filed on Feb. 27, 1997, now Pat. No. 5,751,210, which is a division of application No. 08/407,282, filed on Mar. 20, 1995, now Pat. No. 5,608,375.

(51) Int. Cl.[7] ..... G08B 25/00

(52) U.S. Cl. ..... 340/293; 340/331; 340/518; 315/241 S

(58) Field of Search ..... 340/293, 331, 340/332, 635, 628, 518, 512, 511; 315/241 S

(56) References Cited

U.S. PATENT DOCUMENTS

| | | | | |
|---|---|---|---|---|
| 3,488,558 | A | 1/1970 | Grafton | 315/312 |
| 3,881,130 | A | 4/1975 | Stiller | 315/230 |
| 3,969,720 | A | 7/1976 | Nishino | 340/815.69 |
| 3,973,168 | A | 8/1976 | Kearsley | 315/232 |
| 4,068,149 | A | 1/1978 | Wuchinich | 340/331 |
| 4,101,880 | A | 7/1978 | Haus | 340/326 |
| 4,162,489 | A | 7/1979 | Thilo et al. | 340/518 |
| 4,216,413 | A | 8/1980 | Plas | 315/323 |
| 4,389,632 | A | 6/1983 | Seidler | 340/985 |
| 4,449,073 | A | 5/1984 | Mongoven et al. | 315/130 |
| 4,471,232 | A | 9/1984 | Peddie et al. | 307/35 |
| 4,472,714 | A | 9/1984 | Johnson | 340/916 |
| 4,881,058 | A | 11/1989 | Berry, III | 340/326 |
| 4,899,131 | A | 2/1990 | Wilk et al. | 340/518 |
| 4,924,149 | A | 5/1990 | Nishida et al. | 315/241 S |

(List continued on next page.)

FOREIGN PATENT DOCUMENTS

| | | |
|---|---|---|
| EP | 0102229 | 3/1984 |
| GB | 2031200 | 4/1980 |
| GB | 2103404 | 2/1983 |
| GB | 2211329 | 6/1989 |

OTHER PUBLICATIONS

Wheelock Inc. Catalog, Series 30 Horns & Series 7000 Strobe Horns, 1992.

Wheelock Inc., Product Brochure, MT Series, 1993.

*Primary Examiner*—John Tweel
(74) *Attorney, Agent, or Firm*—Moser, Patterson & Sheridan, LLP.; Kin-Wah Tong, Esq.

(57) ABSTRACT

An apparatus and concomitant method of reducing the number of synchronization pulses transmitted to the alarm units for increasing the reliability of the overall alarm system is disclosed. The synchronization signal is implemented as a reference or reset signal from which the alarm units derive a reference time to begin activation of the alarm units. Thus, when an alarm unit receives a reference synchronization pulse, the alarm unit applies the reference synchronization pulse as a reference point in time to trigger a series of flashes or audio tones.

8 Claims, 27 Drawing Sheets

U.S. PATENT DOCUMENTS

| | | | | |
|---|---|---|---|---|
| 4,952,906 | A | 8/1990 | Buyak et al. | 340/331 |
| 4,967,177 | A | 10/1990 | Nguyen | 340/331 |
| 5,121,033 | A | 6/1992 | Kosich | 315/241 R |
| 5,128,591 | A | 7/1992 | Bocan | 315/241 F |
| 5,341,069 | A | 8/1994 | Kosich et al. | 315/241 |
| 5,400,009 | A | 3/1995 | Kosich et al. | 340/331 |
| 5,559,492 | A | 9/1996 | Stewart et al. | 340/331 |
| 5,598,139 | A | 1/1997 | Karim et al. | 340/286.11 |
| 5,608,375 | A | 3/1997 | Kosich | 340/293 |
| 5,659,287 | A | 8/1997 | Donati et al. | 340/331 |
| 5,751,210 | A | 5/1998 | Kosich | 340/293 |
| 5,850,178 | A | 12/1998 | Ha et al. | 340/512 |
| 5,982,275 | A | 11/1999 | Kosich | 340/293 |
| 6,194,994 | B1 | 2/2001 | Curran et al. | 340/293 |
| 6,369,696 | B2 * | 4/2002 | Curran et al. | 340/293 |

* cited by examiner

1300

FIG. 13A

FIG. 13B

FIG. 13

APPARATUS AND METHOD FOR SYNCHRONIZING VISUAL/AUDIBLE ALARM UNITS IN AN ALARM SYSTEM

This is a continuation of application Ser. No. 09/793,215 filed on Feb. 26, 2001 (U.S. Pat. No. 6,369,696) which is a continuation of application Ser. No. 09/153,105 filed on Sep. 15, 1998 (U.S. Pat. No. 6,194,994, which is a continuation-in-part of application Ser. No. 09/074,328 filed on May 7, 1998 (U.S. Pat. No. 5,982,275), which is a continuation of application Ser. No. 08/807,063 filed on Feb. 27, 1997 (U.S. Pat. No. 5,751,210), which is a divisional application of application Ser. No. 08/407,282 filed on Mar. 20, 1995 (U.S. Pat. No. 5,608,375), where each of the above applications is herein incorporated by reference.

The invention relates generally to an alarm system for providing visual and/or audio warnings and, more particularly, to an apparatus and a concomitant method for synchronizing a plurality of visual and/or audio alarm units.

BACKGROUND OF THE DISCLOSURE

This invention relates to circuits for electronic alarm systems such as are used to provide visual and audio warning in electronic fire alarm devices and other emergency warning devices and, more particularly, to a control circuit which enables the system to provide both a visual and an audio alarm signal, including a silence feature, while using only one signal wire loop.

Strobe lights and/or audio horns are used to provide warning of potential hazards or to draw attention to an event or activity. An important field of use for these signaling devices is in electronic fire alarm systems. Strobe alarm circuits typically include a flashtube and a trigger circuit for initiating firing of the flashtube, with energy for the flash typically supplied from a capacitor connected in shunt with the flashtube. In some known systems, the flash occurs when the voltage across the flash unit (i.e., the flashtube and associated trigger circuit) exceeds the threshold voltage required to actuate the trigger circuit, and in others the flash is triggered by a timing circuit. After the flashtube is triggered, it becomes conductive and rapidly discharges the stored energy from the shunt capacitor until the voltage across the flashtube has decreased to a value at which the flashtube is extinguished and becomes non-conductive.

In a typical alarm system, a loop of several flash units is connected to a fire alarm control panel which includes a power supply for supplying power to all flash units in the loop when an alarm condition is present. Each unit typically fires independently of the others at a rate determined by its respective charging and triggering circuits. Underwriters Laboratories specifications require the flash rate of such visual signaling devices to be between 20 and 120 flashes per minute.

In addition to having a strobe alarm as described above, it may also be desirable to have an audio alarm signal to provide an additional means for alerting persons who may be in danger. In such systems, a "silence" feature is often available whereby, after a period of time has elapsed from the initial alarm, the audio signal may be silenced either automatically or manually. Heretofore, in a system where alarm units having both a visual alarm signal and an audio alarm signal have been implemented, two control loops, one for video and one for audio, have been required between the fire alarm control panel and the series of alarm units.

In a system as described above, the supply voltage may be 12 volts or 20–31 volts, and may be either D.C. supplied by a battery or a full-wave rectified voltage. Underwriters Laboratories specifications require that operation of the device must continue when the supply voltage drops to as much as 80% of nominal value and also when it rises to 110% of nominal value. However, when the voltage source is at 80% of nominal value, the strobe may lose some intensity which could prove crucial during a fire emergency.

Thus, it is desirable to provide a control circuit which will enable an alarm system to provide both audio and visual synchronized alarm signals using only a single control signal wire loop between the alarm units, while allowing for the capability of silencing the audio alarm.

It is also desirable to provide the ability to lower the flash frequency when a low input voltage is detected, thereby ensuring a proper flash brightness.

It is also desirable to provide an alarm interface circuit which will enable an existing alarm system to sound a Code 3 alarm whether or not the existing alarm system is already equipped with Code 3 capability.

It is also desirable to provide a circuit having these properties and which will also work with: (a) both D.C. and full-wave rectified supplies; (b) all fire alarm control panels; and (c) mixed alarm units (i.e., 110 candela and 15 candela with and without audio signals).

It is also desirable to provide a method of reducing the number of synchronization pulses transmitted to the alarm units, thereby increasing the reliability of the overall alarm system.

SUMMARY OF THE INVENTION

In accordance with the present invention, an alarm system is provided which includes a control circuit that allows multiple audio/visual alarm circuits, connected together by a single two-wire control loop, to be synchronously activated when an alarm condition is present. The control circuit also allows for other alarm control functions, such as the deactivation of the audio alarm, to be carried out using only the single control loop. The control circuit is able to provide these functions by interrupting power to the alarm units for approximately 10 to 30 milliseconds at a time. Preferably, each alarm unit is equipped with a microcontroller which is programmed to interpret the brief power interrupt, or "drop out", as either a synchronization signal or a function control signal, depending on the timing of the drop out. The microcontroller can also be programmed to interpret different sequences of drop outs as control signals for other functions such as reactivation of the audio alarm.

The alarm unit is capable of detecting a low input voltage. When the detected voltage drops below a predetermined threshold, the alarm unit will lower the frequency of the visual alarm signal, preferably a strobe, to ensure that the strobe flashtube receives enough energy to flash at an adequate brightness.

The alarm unit is also capable of functioning independently of any synchronization signal from the control circuit. In the event a synchronization signal is not received, an internal timer will cause the flashtube to flash at a predetermined rate.

Furthermore, the synchronization signal can be implemented as a reference or reset signal from which the alarm units derive a reference time to begin activation of the alarm units. Thus, when an alarm unit receives a reference synchronization signal, the alarm unit will use that reference synchronization signal as a reference point in time to trigger a series of flashes and/or audio tones.

BRIEF DESCRIPTION OF THE DRAWINGS

The teachings of the present invention can be readily understood by considering the following detailed description in conjunction with the accompanying drawings, in which:

FIG. 13, FIG. 13A, and FIG. 13B illustrate a flowchart of an alternate embodiment of a software routine of the microcontroller of the interface control circuit as shown in FIG. 5;

To facilitate understanding, identical reference numerals have been used, where possible, to designate identical elements that are common to the figures.

DETAILED DESCRIPTION

Figure 1:
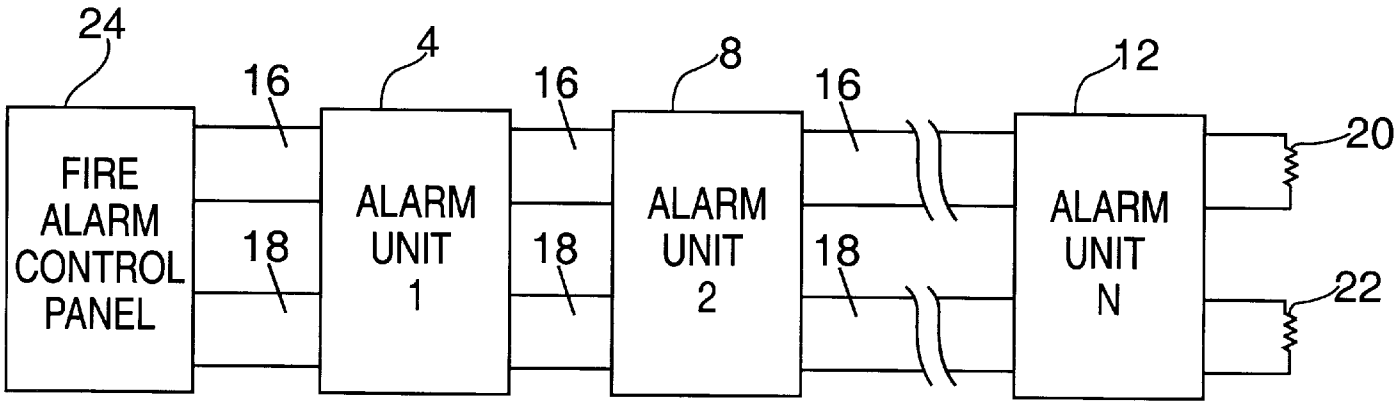
FIG. 1 (PRIOR ART)
FIG. 1 is a block diagram of a conventional prior art alarm system which provides for both visual and audio alarm signals.

In the conventional prior art alarm system shown in FIG. 1, which provides for both visual and audio alarm signals, multiple alarm units 4, 8 and 12, numbered 1 through N, are connected by two common loops 16, 18 having the usual end of the line resistors 20, 22, respectively. The alarm units have both audio and visual signaling capabilities. The first control loop 16 handles visual control signals being output from the fire alarm control panel 24 to the alarm units, and the second control loop 18 handles audio control signals being output from the fire alarm control panel 24 to the alarm units.

Figure 2:
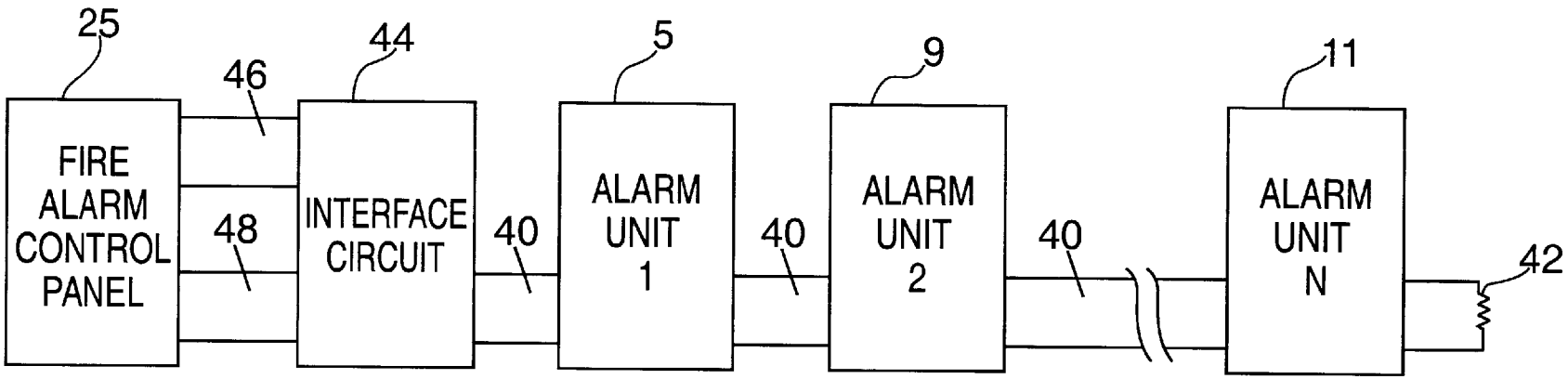
FIG. 2 is a block diagram of one embodiment of an alarm system of the present invention.

FIG. 2 is a block diagram of an embodiment of the alarm system of the present invention. By contrast to FIG. 1, multiple alarm circuits 5, 9 and 11, numbered 1 to N, are connected in a single control loop 40 with the usual end of the line resistor 42. In accordance with the invention, all units are caused to flash and sound synchronously using an interface control circuit 44 and the single control loop 40. The interface control circuit 44 is connected to the fire alarm control panel 25 via a primary input loop 46 and a secondary input loop 48. The alarm control panel 25 and the interface control circuit 44 can either be two separate devices or built into one unit.

The interface control circuit 44 provides the capability of silencing the audio alarms by outputting a signal to the alarm circuits 1 through N on the common loop 40 when a "silence" control signal is received from the fire alarm control panel 25 via the secondary input loop 48. According to the present invention, a single power interruption or "drop out", of approximately 10 to 30 msec in duration, is used as the synchronization, or "sync" pulse to keep the alarm units in sync with one another. A "silence" control signal is communicated to each of the alarm circuits by a second "drop out" in very close proximity to the sync pulse. As will be discussed in greater detail hereinbelow, it is possible to use the "drop outs" to signal any one of a number of functions to the alarm units, "silence" being just one.

Alternatively, the "sync" pulse can be implemented as a reference or reset signal (e.g., a pulse) from which the alarm units derive a reference time to begin activation of the alarm units. Namely, when an alarm unit receives a reference sync pulse, the alarm unit will use that reference sync pulse as a reference point in time to trigger a series of flashes and/or audio tones. Thus, the reference pulse does not directly activate the alarm unit, but only serves as a reference time signal for the alarm unit, as discussed in detail below.

There are an infinite number of possible audio sounds and signaling schemes which may be employed in an alarm system. Actual or simulated bells, horns, chimes and slow whoops, as well as prerecorded voice messages, can all be used as audio alarm signals. One audio signaling scheme gaining popularity is the evacuation signal found in NFPA 72 from the National Fire Protection Association. The signal is also known as Code 3. A Code 3 signal consists of three half-second horn blasts separated by half-second intervals of silence followed by one and one-half seconds of silence. Some alarm systems currently in use are equipped with Code 3 capability. For such systems, the present invention may be implemented using the secondary input loop 48 to transmit a Code 3 signal from the existing fire alarm control panel 25 to the interface control circuit 44 which will, in turn, send out a Code 3 signal to the alarm units. If the fire alarm system is one which is not equipped with Code 3 capability, the interface control circuit 44 can provide the signal itself. For purposes of illustration, but not limitation, the Code 3 signal will be discussed hereinbelow as the signaling scheme of the present invention.

Turning now to the visual alarm, for purposes of illustration, the strobe flashrate discussed herein is approximately 1.02 Hz under normal conditions. As will be explained in detail later, at an input voltage below the product specifications, the flashrate may be lowered to 0.5 Hz. Underwriters Laboratories permits a flashrate as low as 0.33 Hz.

Figure 3:
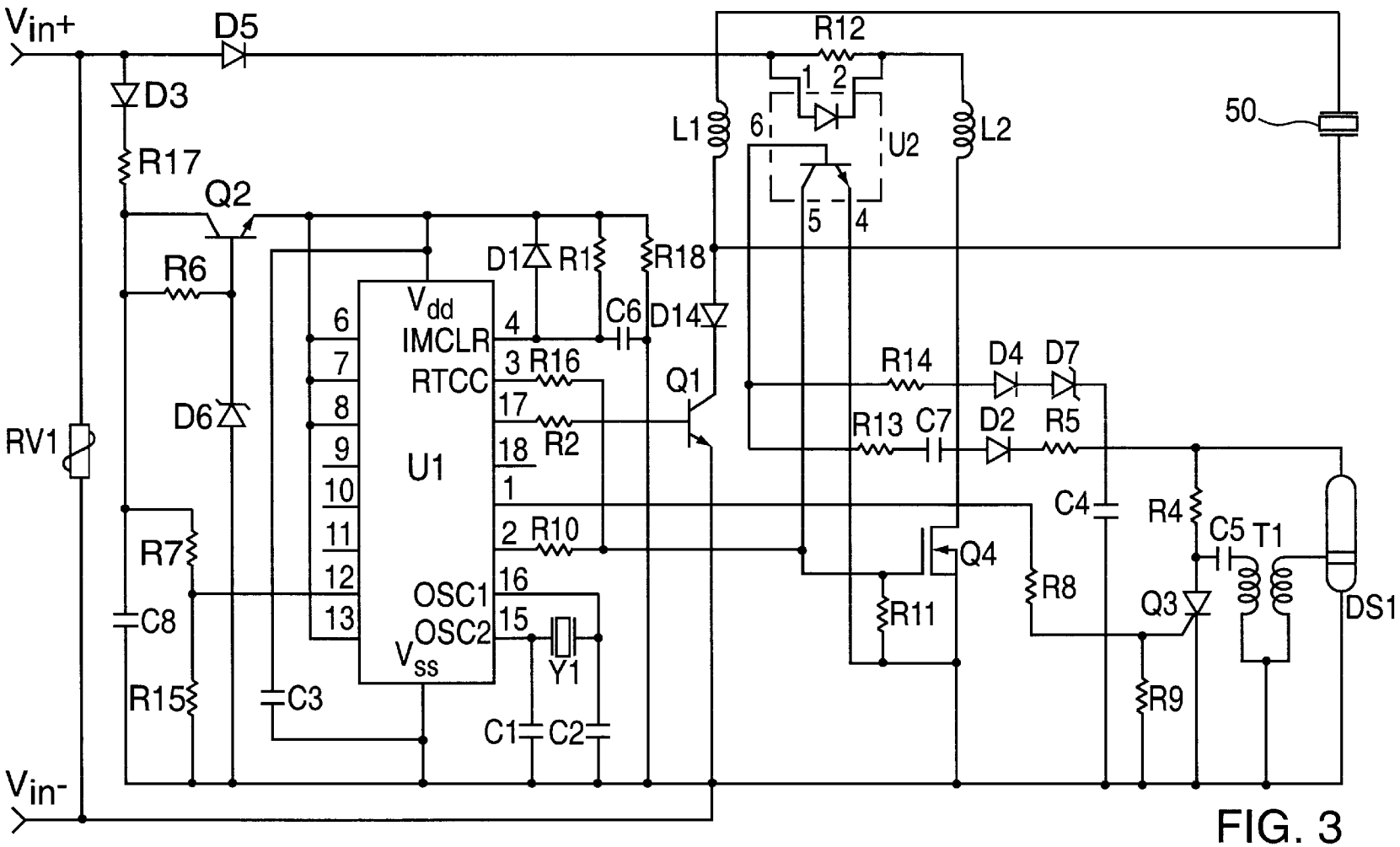
FIG. 3 is a circuit diagram of one embodiment of an alarm unit employed in the present invention.

FIG. 3 is a circuit diagram of one embodiment of each of the alarm units 5, 9 and 11. The unit depicted is a microprocessor-controlled audio/visual alarm unit which serves to demonstrate the full range of features available in the present invention. One skilled in the art will appreciate that an alarm unit with only visual or only audio capabilities may also be integrated into the system where desired. Each unit is energized from a D.C. power source embodied in the control panel 25. Metal Oxide Varistor RV1 is connected across the D.C. input to protect against transients on the input. A voltage regulator circuit provides the necessary voltage level to power the microcontroller U1. Resistors R6 and R17 are connected in series between the cathode of diode D3 and the base electrode of transistor Q2, and also to the cathode of Zener diode D6 which provides 5.00 volts ±5% volts to the microcontroller U1 across terminals $V_{dd}$ and $V_{ss}$. A capacitor C3 connected across the $V_{dd}$ and $V_{ss}$ terminals of U1 acts as a filter and will hold the voltage across U1 during the power drop outs which are used in the system as control signals.

A reset circuit for the microcontroller U1 includes a diode D1 and a capacitor C6 connected in series with the emitter electrode of transistor Q2 and in parallel with a resistor R18, and a resistor R1 connected in parallel with diode D1. The junction between diode D1 and capacitor C6 is connected to the "MCLR" terminal 4 of microcontroller U1. Oscillations at a frequency of 4 MHz are applied to terminals OSC1 and OSC2 of the microcontroller by a clock circuit consisting of a resonator Y1 and a pair of capacitors C1 and C2 connected between the negative side of the voltage source and the first and second oscillator inputs, respectively.

Resistors R7 and R15 and capacitor C8 provide a means at microcontroller input terminal 12 for detecting gaps or drop outs in input power which indicate the presence of either a full wave rectified (FWR) input voltage or a sync or control pulse from the interface module 44.

In the alarm circuit of FIG. 3, the flash circuit portion utilizes an opto-oscillator for D.C.-to-D.C. conversion of the input voltage to a voltage sufficient to fire the flashtube. In the opto-oscillator, a capacitor C4 connected in parallel with the flashtube DS1 is incrementally charged, through a diode D2 and a resistor R5, from an inductor L2, which is cyclically connected and disconnected across the D.C. supply. At the beginning of a connect/disconnect cycle, the light emitting diode (LED) and transistor of an optocoupler U2 are both off and switch Q4 is on, completing a connection between inductor L2 and the D.C. power source. As the current flow through L2 increases with time, the LED of U2 energizes and turns on the optically coupled transistor of U2 which in turn shuts off switch Q4, thereby disconnecting L2 from the D.C. source. During the off period of switch Q4, energy stored in inductor L2 is transferred through diode D2 and resistor R5 to capacitor C4. Capacitor C7 and resistor R13 are connected in series between diode D2 and the base of the transistor of optocoupler U2. When inductor L2 has discharged its stored energy into capacitor C4, the LED of U2 ceases to emit light and the transistor of U2 turns off. This in turn causes Q4 to turn on, thereby beginning the connect/disconnect cycle again.

The on and off switching of Q4, and, therefore, the rate at which the increments of energy are transferred from inductor L1 to capacitor C1, is determined by the switching characteristics of optocoupler U2, the values of resistors R10, R11, R12, the value of inductor L2 and the voltage of the D.C. source, and may be designed to cycle at a frequency in the range from about 3000 Hz to 30,000 Hz. The repetitive opening and closing of switch Q4 eventually charges capacitor C4 to the point at which the voltage across it attains a threshold value required to fire the flashtube DS1. Overcharging of capacitor C4 is prevented by a resistor R14 and Zener diodes D4 and D7 connected in series between the base electrode of the optocoupler transistor and the positive electrode of storage capacitor C4. The values of these components are chosen so that when the voltage across capacitor C4 attains the firing threshold voltage of the flashtube DS1, a positive potential is applied to the base electrode of the optocoupler transistor and turns on the transistor which, in turn, turns off switch Q4 and disconnects inductor L2 from across the D.C. source.

In addition to the opto-oscillator, the flash circuit includes a circuit for triggering flashtube DS1. The trigger circuit includes a resistor R4 connected in series to the combination of a switch Q3, which in this embodiment is an SCR, connected in parallel with the series combination of a capacitor C5 and the primary winding of an autotransformer T1. The secondary winding of the autotransformer T1 is connected to the trigger band of the flashtube DS1. When switch Q3 is turned on, capacitor C4 discharges through the primary winding of transformer T1 and induces a high voltage in the secondary winding which, if the voltage on capacitor C4 equals the threshold firing of the tube, causes the flashtube DS1 to conduct and quickly discharge capacitor C4. Q3 is turned on from microcontroller output pin 1 and through a voltage divider composed of resistors R8 and R9.

The alarm unit depicted in FIG. 3 also includes an audio alarm circuit, comprised of resistor R2, transistor switch Q1 diode D14, inductor L1 and piezoelectric element 50 connected as shown. In the alarm unit shown, both the audio and visual alarm signals are controlled by the microcontroller U1, the audio signal being operated via output terminal 17 and the visual signal being triggered via output terminal 1. However, one skilled in the art will appreciate that a timer circuit means, such as disclosed in the commonly-owned U.S. patent application Ser. No. 08/133,519 (U.S. Pat. No. 5,400,009, issued on Mar. 21, 1995), which is hereby incorporated by reference, can be employed to cause the strobe to flash independently of the microcontroller in the event of a malfunction which causes a failure of the microcontroller U3 in control unit 44 to send a sync signal.

By way of example, the circuit shown in FIG. 3, when using a 24 volt D.C. power source, may use the following parameters to obtain the above-described switching cycle:

| ELEMENT | VALUE OR NUMBER |
|---|---|
| C1, C2 | CAP., 33 pF, |
| C3 | CAP., 68 μF, 6 V |
| C4 | CAP., 68 μF, 250 V |
| C5 | CAP., 047 μF, 400 V |
| C6 | CAP., .47 μF |
| C7 | CAP., 33 pF, 250 V |
| C8 | CAP., .01 μF |
| D1 | DIODE 1N914 |
| D2, D14 | DIODE HER106 |
| D3 | DIODE 1N4007 |
| D4, D7 | DIODE 1N5273B |
| D5 | DIODE 1N4007 |
| D6 | DIODE 1N4626 |
| DS1 | FLASHTUBE |
| L1 | INDUCTOR, 47 mH |
| L2 | INDUCTOR, 2.2 mH |
| Q1 | TRANSISTOR, ZTX455 |
| Q2 | TRANSISTOR, 2N5550 |
| Q3 | SCR, EC103D |
| Q4 | TRANSISTOR, IRF710 |
| R1 | RES., 39 K |
| R2 | RES., 560 |

-continued

| ELEMENT | VALUE OR NUMBER |
|---|---|
| R4 | RES., 220 K |
| R5 | RES., 180, ½ W |
| R6 | RES., 4.7 K |
| R7 | RES., 10 K, 1% |
| R8 | RES., 1 K |
| R9 | RES., 10 K, 1% |
| R10 | RES., 1 K |
| R11 | RES., 1 M |
| R12 | RES., 5.36 OHMS, 1% |
| R13 | RES., 100 K |
| R14 | RES., 33 K |
| R15 | RES., 2.21 K, 1% |
| R16 | RES., 10 K |
| R17 | RES., 330, ½ W |
| R18 | RES., 10 K |
| T1 | TRIGGER TRANSFORMER |
| U1 | MICROCONTROLLER, PIC16C54 |
| U2 | OPTOCOUPLER, 4N35 |
| Y1 | CERAMIC RES., 4 MHZ |

As mentioned above, the microcontroller U1 of the alarm unit is responsible for activating and deactivating the audio horn alarm in a desired sequence, detecting FWR or D.C. voltage and adapting the visual strobe alarm to a low input voltage by lowering the flashrate. The flowcharts of FIGS. 4 and 4A–4E illustrate the software routines of the microcontroller of the alarm unit shown in FIG. 3.

Figure 8:
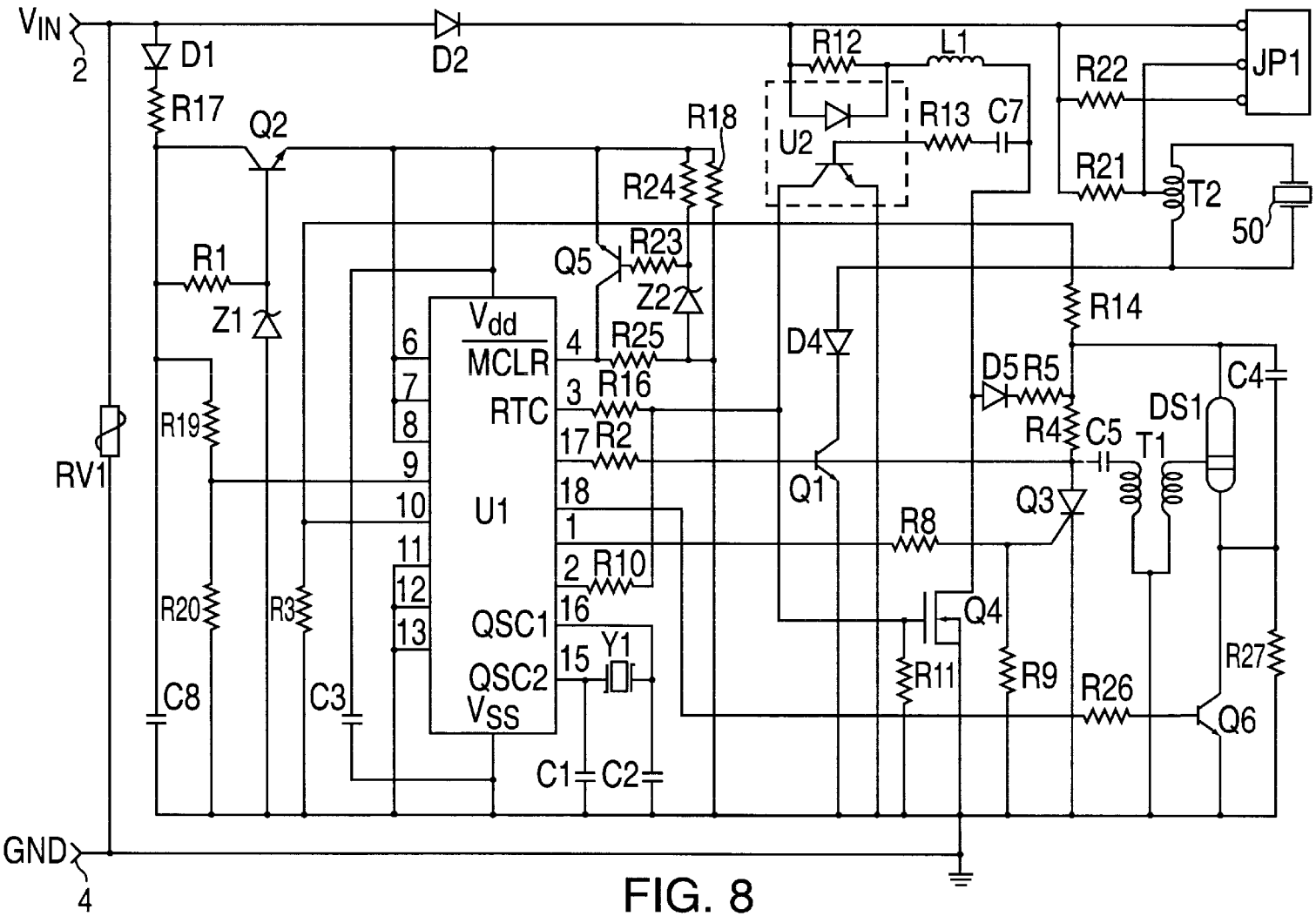
FIG. 8 is a circuit diagram of another embodiment of an alarm unit employed in the present invention.

FIG. 8 is a circuit diagram of another embodiment of each of the alarm units 5, 9 and 11. In brief, the alarm unit of FIG. 8 includes an inrush-limiting circuit. Inrush is a condition that may occur upon initial power-on, where a higher than average current is present in the alarm unit when power is applied to the power terminals for the first time to start alarm notification. Inrush can cause a momentary overload in the power supply and may cause the overcurrent protection in the panel to activate which can prevent the alarm units from operating. The overload may also damage relay contacts located in the panel which switch the loop to an alarm condition. Thus, FIG. 8 illustrates one embodiment of an alarm unit that contains an in-rush limiting circuit. The alarm unit of FIG. 8 is described in U.S. Pat. No. 5,673,030, issued on Sep. 30, 1997, which is hereby incorporated by reference.

Returning to FIG. 8, the unit depicted is a microprocessor-controlled audible/visual alarm unit which serves to demonstrate the full range of features available in the present invention. One skilled in the art will appreciate that the invention is also applicable to an alarm unit having only visual, i.e. strobe, capabilities or only audible, i.e., horn capabilities. The unit is energized by a D.C. power source connected to power terminals 2 (Vin) and 4 (GND). A metal oxide Varistor RV1 is connected across the D.C. input to protect against transients on the input. A voltage regulator circuit provides the necessary voltage level to power the microcontroller U1. Resistors R1 and R17 are connected in series between the cathode of a diode D1 and the base electrode of a transistor Q2, and also to the cathode of a Zener diode Z1 which provides a 5.60 volts ±5% reference. The collector of Q2 is connected to the common node of R1 and R17. Transistor Q2 provides 5 volts to microcontroller U1 across terminals $V_{dd}$ and $V_{ss}$. A capacitor C3 connected across the $V_{dd}$ and $V_{ss}$ terminals of U1 acts as a filter and will hold the voltage across U1 during the power drop outs which are used in the system as control signals.

A reset circuit for the microcontroller U1 includes a resistor R24 and a Zener diode Z2 connected in series between the terminals $V_{dd}$ and $V_{ss}$ of microcontroller U1, a switch Q5 with its emitter electrode connected to the $V_{dd}$ terminal, a resistor R25 connected between the collector electrode of the switch Q5 and GND, and a resistor R23 connected between the base electrode of the switch Q5 and the anode of the diode Z2. The junction between the switch Q5 and the resistor R25 is connected to the "MCLR" terminal 4 of the microcontroller U1.

Oscillations at a frequency of 4 MHz are applied to the terminals OSC1 and OSC2 of the microcontroller by a clock circuit consisting of a resonator Y1 and a pair of capacitors C1 and C2 connected between GND and the first and second oscillator inputs, respectively.

Resistors R19 and R20 and a capacitor C8 provide a means at a microcontroller input terminal 9 for detecting gaps or drop outs in input power which indicate the presence of either a full wave rectified (FWR) input voltage or a sync or control pulse.

In the alarm circuit of FIG. 8, the flash circuit portion utilizes an opto-coupler U2 to control the D.C.-to-D.C. conversion of the input voltage to a voltage sufficient to fire the flashtube. In the opto-oscillator circuit, capacitor C4 connected in parallel with the flashtube DS1 is incrementally charged, through a diode D5 and a resistor R5. from an inductor L1, which is cyclically connected and disconnected across the D.C. supply. At the beginning of a connect/disconnect cycle, the light emitting diode (LED) and transistor of the optocoupler U2 are both off and the switch Q4 is on, completing a connection between the inductor L1 and the D.C. power source. As the current flow through L1 increases with time, the LED of U2 energizes and turns on the optically coupled transistor of U2 which, in turn, shuts off the switch Q4, thereby disconnecting L1 from the D.C. source. During the off period of the switch Q4, energy stored in the inductor L1 is transferred through a diode D5 and a resistor R5 to the series-connected capacitor C4. The capacitor C7 and the resistor R13 are connected in series between the diode D5 and the base of the transistor of the optocoupler U2. When the inductor L1 has discharged its stored energy into the capacitor C4, the LED of U2 ceases to emit light and the transistor of U2 turns off. This, in turn, causes Q4 to turn on, thereby beginning the connect/disconnect cycle again.

The on and off switching of Q4 and, therefore, the rate at which the increments of energy are transferred from the inductor L1 to the capacitor C4, is determined by the switching characteristics of the optocoupler U2, the values of the resistors R10, R11 and R12, the value of the inductor L1 and the voltage of the D.C. source, and may be designed to cycle at a frequency in the range from about 3000 Hz to 30,000 Hz. The repetitive opening and closing of the switch Q4 eventually charges the capacitor C4 to the point at which the voltage across it attains a threshold value required to fire the flashtube DS1. Overcharging of capacitor C4 is prevented by resistors R14 and R3 connected in series between the GND terminal 4 and the positive electrode of the capacitor C4. The values of these resistors are chosen to feed a portion of the voltage across the capacitor C4 back to the microcontroller U1. By checking for a relative high or low level after a trigger signal, the microcontroller U1 can determine if the flashtube DS1 fired. If the flashtube DS1 did not fire, the opto-oscillator circuit is shut down by way of opto-coupler U2 to prevent overcharging of the capacitor C4. This regulation of the capacitor's C4 voltage occurs in all modes of operation including D.C., FWR, Sync and non-Sync. The microcontroller implementation is less costly than a Zener diode implementation and provides greater performance by eliminating Zener tolerance issues.

In addition to the opto-oscillator circuit, the flash circuit includes a circuit for triggering the flashtube DS1. The trigger circuit includes a resistor R4 connected in series to the combination of a switch Q3, which in this embodiment is an SCR (or a TRIAC), connected in parallel with the series combination of a capacitor C5 and the primary winding of an autotransformer T1. The secondary winding of the autotransformer T1 is connected to the trigger band of the flashtube DS1. When the switch Q3 is turned on, the capacitor C5 pulses the primary winding of the transformer T1 and induces a high voltage in the secondary winding which, if the voltage on the capacitor C4 equals the threshold firing voltage of the flashtube, causes the flashtube DS1 to conduct and quickly discharge the capacitor C4. Q3 is turned on from a microcontroller output pin 1 and through a voltage divider composed of the resistors R8 and R9.

Optimally, the alarm unit depicted in FIG. 8 may also include an audio alarm circuit comprised, for example, of a resnistor R2, a switch Q1, a diode D4, an autotransformer T2 and a piezoelectric element 50 connected as shown. The autotransformer T2 provides a voltage boost to the piezoelectric element 50 so that the audible alarm has more volume. The jumper selector JP1 is connected to the cathode of a diode D2, the autotransformer T2 and the resistors R21 and R22 to provide a means for adjusting the alarm volume. A "HIGH" volume setting connects T2 directly to D2. A "MEDIUM" volume setting connects T2 to D2 with the parallel combination of R21 and R22. Finally, the "LOW" volume setting connects D2 to T2 with R21. In the alarm unit shown, both the audible and visual alarm signals are controlled by the microcontroller U1, the audible signal being operated via an output terminal 17 and the visual signal being triggered via the output terminal 1. However, one skilled in the art will appreciate that a software timer means can be employed to cause the strobe to flash, e.g., in the event of a malfunction which causes a failure of the microcontroller U1 in the control unit 44 to send a sync signal.

In contrast to prior art implementations, the resistance of R5 may be reduced to a minimum value, e.g. 27 ohms, in the present invention. This value is sufficient to prevent the flashtube DS1 from exhibiting an afterglow effect due to current drawn from the power source after a flash occurs, but only minimally limits inrush. By using the smaller resistance R5, the operation of the circuit is made more efficient. In accordance with the invention, an inrush limiting resistance, e.g. resistor R27, is included in the circuit along with a switch Q6. The resistance of R27 is substantially larger than the resistance of R5, e.g. 390 ohms, so that its inrush-limiting capabilities are superior to those of the prior art. The resistor R27 and the switch Q6, to which the R27 is connected in parallel, are connected between the negative terminal of the capacitor C4 and the GND terminal 4. The resistor R26 is connected between the base electrode of the switch Q6 and the microcontroller pin 19 and serves to limit current from the pin 19 to the switch Q6.

In accordance with the invention, the switch Q6 is open for a period of time after power is applied to the power terminals 2 ($V_{in}$) and 4 (GND). The period of time should be sufficient to minimize inrush, e.g., 100 milliseconds. After this period, the switch Q6 is turned on by the microcontroller U1 and remains on as long as power stays on. As a result, current ceases to flow through R27, leaving the minimal resistance R5 in the current path between L1 and GND terminal 4. In addition, at regular intervals, the software of the microcontroller U1 will refresh this function to be certain that the switch Q6 remains on thereafter. One skilled in the art would appreciate that the resistor R27 could be replaced with an equivalent resistance branch or network and the microcontroller could be replaced with a simple timer providing the desired off-period of the switch Q6.

By way of example, the circuit shown in FIG. 8, when using a 24 volt D.C. power source and producing a strobe with 15/75 candela brightness, may use the following parameters to obtain the above-described switching cycle:

| ELEMENT | VALUE OR NUMBER |
|---|---|
| C1, C2 | CAP., 33 pF, 50 V |
| C3 | CAP., 68 μF, 6.3 V |
| C4 | CAP., 47 μF, 250 V |
| C5 | CAP., .047 μF, 400 V |
| C7 | CAP., 33 pF, 250 V |
| C8 | CAP., .1 μF, 100 V |
| D1, D2 | DIODE 1N4004 |
| D4, D5 | DIODE HER106 |
| L1 | INDUCTOR, 5.05 mH |
| Q1 | TRANSISTOR, ZTX455 |
| Q2, Q6 | TRANSISTOR, 2N5550 |
| Q3 | SCR, EC103D |
| Q4 | TRANSISTOR, 1RF710 |
| Q5 | TRANSISTOR, 2N2907 |
| R1 | RES., 4.7 K, ¼ W |
| R2 | RES., 560, ¼ W |
| R4 | RES., 220 K, ¼ W |
| R5 | RES., 27 K, ½ W |
| R8, R10, R26 | RES., 1 K, ¼ W |
| R9, R16, R18, R23 | RES., 10 K, ¼ W |
| R11, R14 | RES., 1 M, ¼ W |
| R12 | RES., 4.75, ¼ W |
| R13 | RES., 100 K, ¼ W |
| R17 | RES., 330, ½ W |
| R19 | RES., 10 K, ¼ W |
| R20 | RES., 2.21 K, ¼ W |
| R21 | RES., 680, ½ W |
| R22 | RES., 270, ½ W |
| R24 | 6.8 K, ¼ W |
| R25 | 39 K, ¼ W |
| R27 | 390, ½ W |
| RV1 | VARISTOR, 68 V |
| T1, DS1 | FLASHTUBE/TRIGGER COIL ASS'Y |
| T2 | TRANSFORMER |
| U1 | MICROCONTROLLER, PIC16C54 |
| U2 | OPTOCOUPLER, 4N35 |
| Y1 | CERAMIC RES., 4 MHZ |
| Z1 | ZENER DIODE, 1N4626 |
| Z2 | ZENER DIODE, 1N4620 |

It should be noted that several differences exist between the alarm units of FIG. 3 and FIG. 8. First, the components R14, D4 and D7 in FIG. 3 are replaced with two resistors R3 and R14 and a software function in FIG. 8 to effect the protection against overcharging of the storage capacitor C4. Namely, the microcontroller upon detection of a high post trigger voltage will disable the opto-oscillator to prevent overcharging of the storage capacitor C4. Second, the alarm unit of FIG. 8 provides a jumper selector JP1 for selecting the volume of the audio horn.

The microcontroller U1 of the alarm unit is responsible for the operation of the audible and visual capabilities of the alarm units, e.g., activating and deactivating the audio alarm in a desired sequence, detecting FWR or D.C. voltage, and adapting the visual strobe alarm to a low input voltage by lowering the flashrate. The flowcharts below illustrate the software routines or methods of the microcontroller of the alarm units shown in FIG. 3 and FIG. 8. It should be noted that since the hardware implementations of FIG. 3 and FIG. 8 vary slightly, relevant portions of the software routines or methods below can be omitted depending on the hardware implementations.

Figure 4:
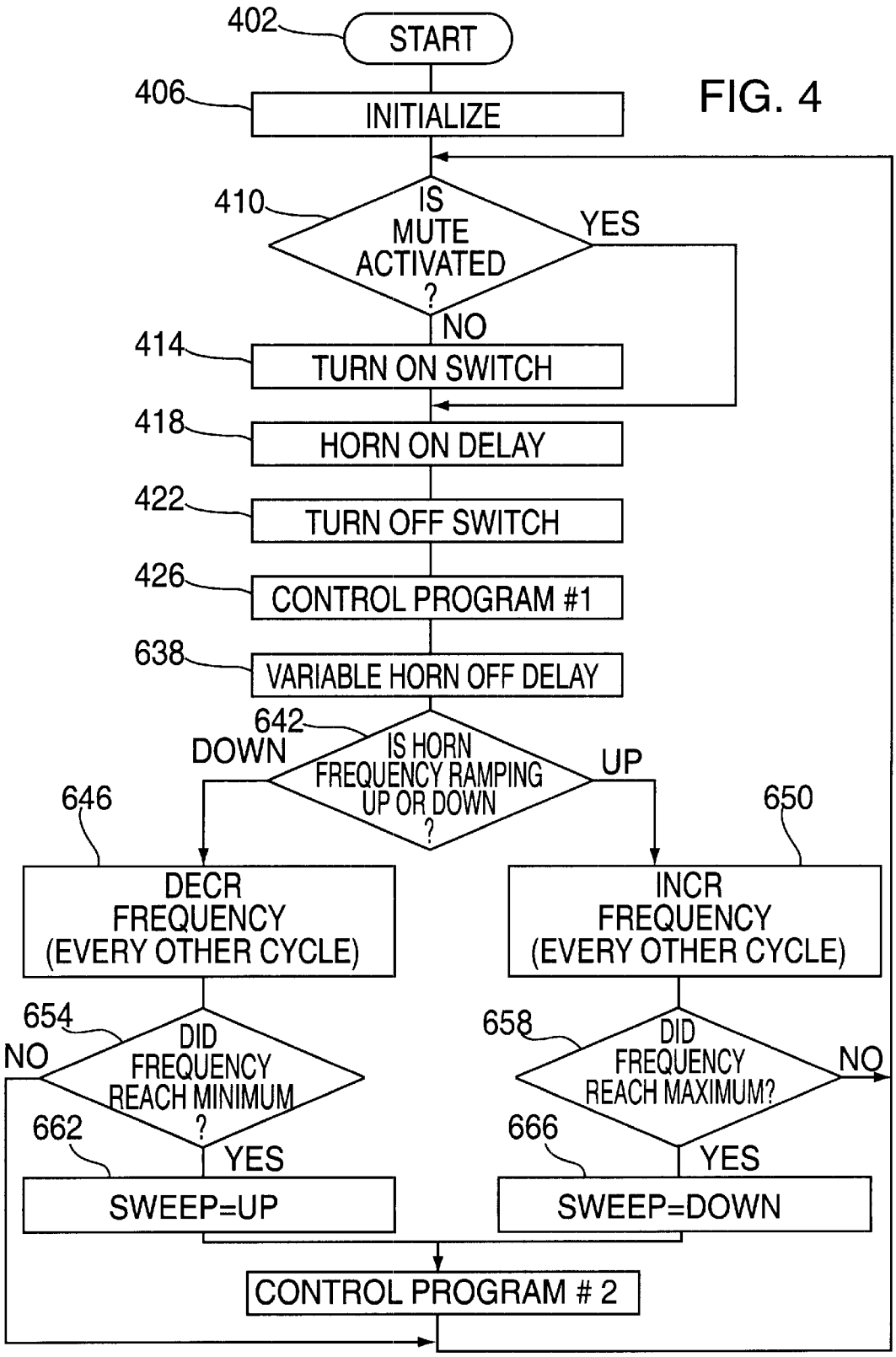
FIG. 4 illustrates the software routine of the main program of the microcontroller of the alarm unit shown in FIG. 3.

FIG. 4 depicts the Main Program of the alarm unit microcontroller. This portion is responsible for the horn alarm and is executed at the desired frequency for the horn, here approximately 3,500 Hz.

The program begins and is initialized at blocks 402 and 406. At block 410, an inquiry is made as to whether the horn is currently being muted, as will be the case if the Code 3 signal is in one of the half-second or one and one-half second silence periods or if the "SILENCE" feature has been activated. If the "MUTE" function is not activated, the microcontroller U1 will turn on the horn at block 414 by sending out a high signal from microcontroller terminal 17 to turn on switch Q1. In the preferred embodiment of the present invention, the horn is programmed to have a varying frequency, here between 3,200 and 3,800 Hz, to better simulate an actual horn, and will ramp up and down between the set minimum and maximum frequencies. In this embodiment, the "HORN ON DELAY" time, at block 418 is constant and is chosen to be approximately 0.120 msec. The varying of the horn frequency is accomplished by ramping the "HORN OFF DELAY" time up and down. Following the "HORN ON DELAY", the horn is turned off at block 422 by turning off switch Q1.

Figure 4A:
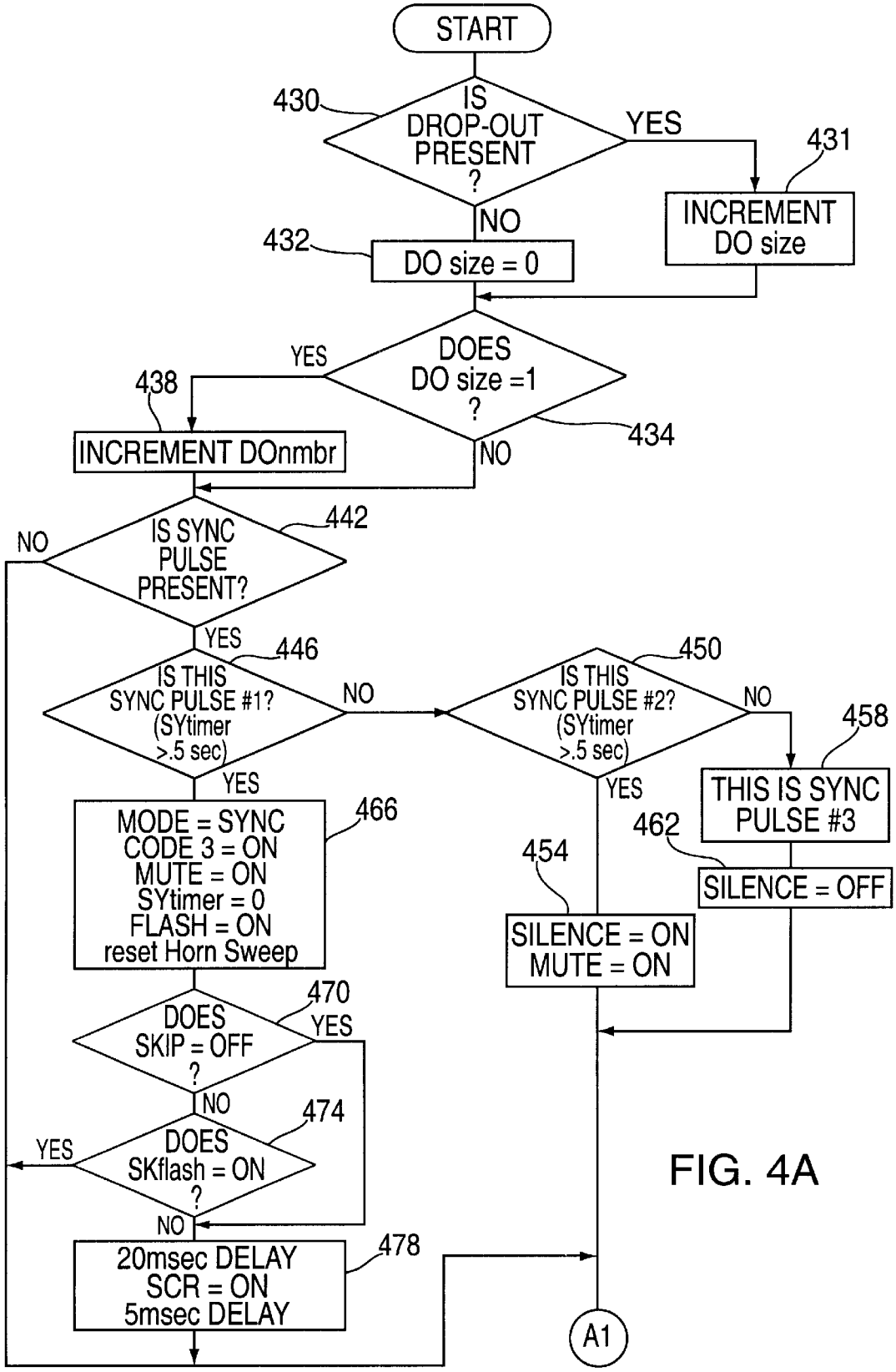
FIGS. 4A and 4B illustrate the software routine of Control Program No. 1.
Figure 4B:
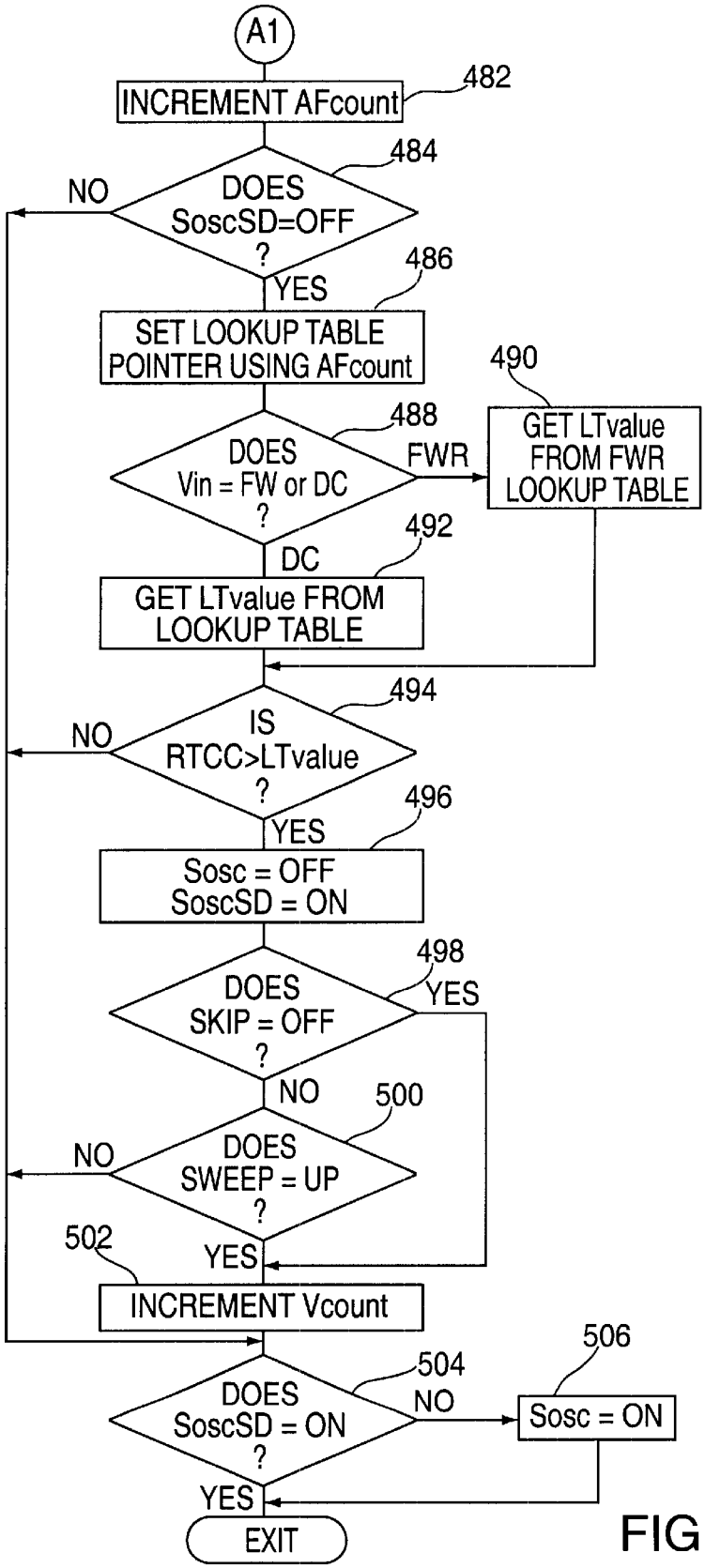

At block 426, Control Program No. 1 is run. Control Program No. 1 is responsible for detection and interpretation of the voltage drop outs, which serve as sync or control pulses (hereinafter "sync/control pulses") to the units, and is represented in flow-chart form in FIGS. 4A and 4B. FIGS. 4A and 4B will be discussed in detail hereinbelow following the discussion of FIG. 4.

After leaving Control Program No. 1, the main program, at block 638, will begin the "HORN OFF DELAY". As mentioned above, the "HORN OFF DELAY" time will be varied to better simulate an actual horn sound. At block 642, the program will check to see whether the delay is currently being ramped up or down, and, in either of block 646 or 650, will continue the ramping in the current direction on every other Main Program cycle. At either block 654 or 658, the program will loop back to block 410 to determine if the "MUTE" function has been activated if neither the minimum nor maximum specified horn frequency has been reached, in this example 3,200 and 3,800 Hz, respectively. If the minimum or maximum frequency has been reached, the ramp direction will be changed at block 662 or 666, after which the program will run Control Program No. 2, depicted in FIGS. 4C, 4D and 4E.

Turning now to FIGS. 4A and 4B, following the start of Control Program No. 1 the software looks for an input voltage drop out as indicated at block 430. Detection of a drop out indicates either a sync/control pulse or a FWR input voltage. Detection of the leading edge of a drop out initiates a counter "DOsize". If the drop out is present, "DOsize" is incremented at block 431. If no drop out is present, the counter is reset to zero at block 432. Drop outs are detected at microcontroller input terminal 9.

Next, at block 434, the program checks to see if this is the beginning of a drop out by inquiring as to whether "DOsize= 1." If so, the program at block 438 increments a counter, "DOnmbr", which keeps track of the number of dropouts. At block 442, the program checks for the presence of a sync/control pulse using the "DOsize" counter. If the drop out is wide enough, a sync/control pulse is present.

One skilled in the art will appreciate that multiple pulses can be used as control signals for the system. According to the present invention, in any such scheme, the first pulse will indicate the beginning of a new sync cycle. By way of example, here, the presence of a second pulse immediately following the first sync pulse will activate the "SILENCE" feature throughout the system and turn off any audio alarm which may be sounding. The presence of a pulse in the first and third pulse positions will deactivate the "SILENCE" feature causing the horns to sound when activated.

The software needed to perform these functions is illustrated in the flowchart of FIG. 4A following block 442. If a sync/control pulse is detected, the program at block 446 determines whether it is a sync pulse by checking the how much time has elapsed since the last pulse. If "SYtimer" indicates that it has been more than 0.5 seconds, then the pulse is the first of the cycle. If less than 0.1 seconds has elapsed, then the pulse is determined at block 450 to be in the second position and the "SILENCE" and "MUTE" features are activated at block 454. In this example, since only three pulse positions are being used, if "SYtimer" is any other value, then the pulse is determined at block 458 to be in the third position and the "SILENCE" feature is deactivated at block 462.

If the pulse is a sync pulse, block 466 sets several functions. "MODE" is set to "sync", "CODE 3" is turned on, "MUTE" is turned on, "SYtimer" is reset to zero, "FLASH" is turned on, and the horn frequency is returned to its starting position.

At block 470, the program checks to see if the "SKIP" function is off. The "SKIP" function and "SKflash" variable are used to cut the flashrate in half when the input voltage falls below an acceptable level, in this example 20 V. When the "SKIP" function is activated, the variable "SKflash" will toggle between on and off once each flash cycle causing every other flash to be skipped. This is seen in the flowchart at block 474 where if "SKIP" is not off, the program checks to see whether "SKflash" is on, which it will be every other cycle. On the other hand, if "SKIP" is off at block 470, the program jumps to block 478 and flashes the strobe by delaying 20 msec, turning on SCR Q3 and delaying another 5 msec. If "SKflash" is on at block 474, block 478 will be skipped and the strobe will not be flashed.

The next section of the program, beginning at block 482 in FIG. 4B, checks to see whether the capacitor C4 is being charged high enough to sufficiently flash the flashtube DS1. At block 482, a variable "AFcount" is incremented. "AFcount" is used to count the number of cycles of Control Program No. 1 which corresponds to the audio frequency of the audio alarm signal.

At block 484, inquiry is made as to the status of a control variable "SoscSD", which is indicative of the "oscillator shut down" function. "SoscSD" being on indicates that the opto-oscillator is shut down. If "SoscSD" is off, the program continues with box 486 which sets a lookup table pointer based on "AFcount", i.e., based upon how many audio signal cycles have elapsed. The lookup table value, "LTvalue", is a predetermined minimum desirable number of cycle counts for the opto-oscillator and is used to determine whether capacitor C4, which provides the energy to flash flashtube DS1, is charging too quickly. First, however, at block 488, the program determines whether Vin is FWR or D.C. Depending on which one it is, the program will determine "LTvalue" using either a FVR lookup table at block 490 or a D.C. lookup table at block 492.

Next, at block 494, "LTvalue" is compared to the number of connect/disconnect cycles of the opto-oscillator responsible for charging C4. This is done by using the real time clock counter at microcontroller input pin RTCC and resistor R16 to keep count of the number of times the opto-oscillator has cycled. If the count is greater than "LTvalue", then the oscillator is turned off at block 496 by turning on "SoscSD" and turning off "Sosc".

At block 502, a variable "Vcount" is incremented. "Vcount" is used to determine whether the alarm unit is receiving a proper input voltage. Its significance will be discussed in greater detail shortly hereinbelow.

Returning briefly to block 484, if "SoscSD" is not off, that is, if the "oscillator shut down" function is on, then the program jumps to block 504 and will not increment "Vcount". As will be seen hereinbelow, once "SoscSD" is turned on, it will not be turned off again until Control Program No. 2 is executed. As discussed above with respect to the Alarm Unit Main Program, Control Program No. 2 is executed only at the top and bottom of the horn sweep cycles. The number of times this occurs can be controlled by the size of the step of the horn frequency increase or decrease. In the example under discussion, this will happen 120 times each second, one second being the approximate period between flashes. Therefore, the highest value which Vcount can attain between flashes is 120. This is also true when the "SKIP" function is activated and the flash period becomes two seconds, i.e., Control Program No. 2 is executed 240 times between flashes, since blocks 498 and 500 allow "Vcount" to be incremented only if either the "SKIP" function is off or both the "SKIP" function is on and the horn frequency is sweeping up.

Returning to block 494, if RTCC has not exceeded "LTvalue", the program jumps to block 504 and "Vcount" will not be incremented. At block 504, the program checks to see if the "oscillator shut down" function is on. If not, the oscillator is turned on at block 506 and the control program is exited. If "SoscSD" is on, the control program is exited without turning on "Sosc".

Figure 4C:
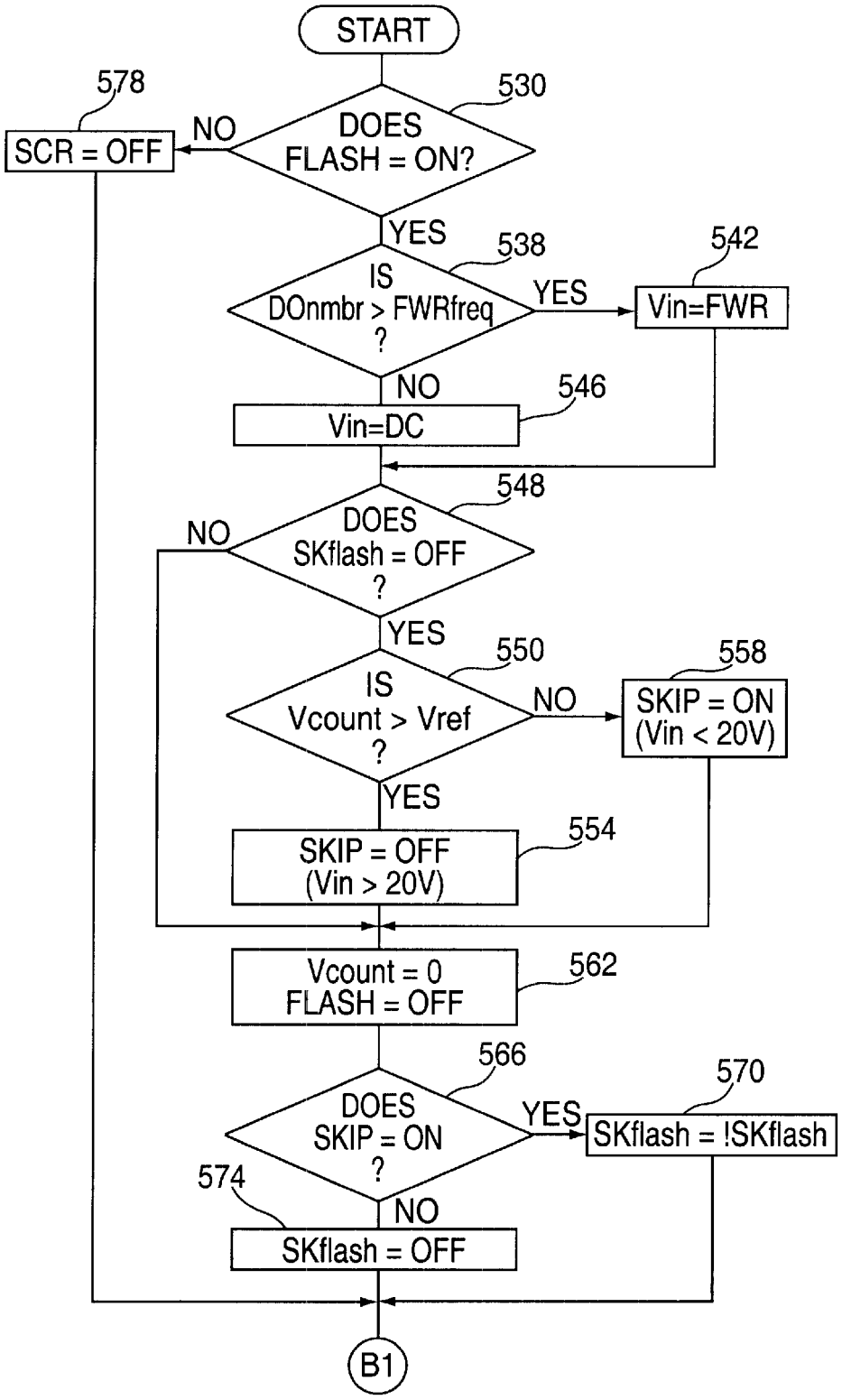
FIGS. 4C, 4D and 4E illustrate the software routine of Control Program No. 2.
Figure 4D:
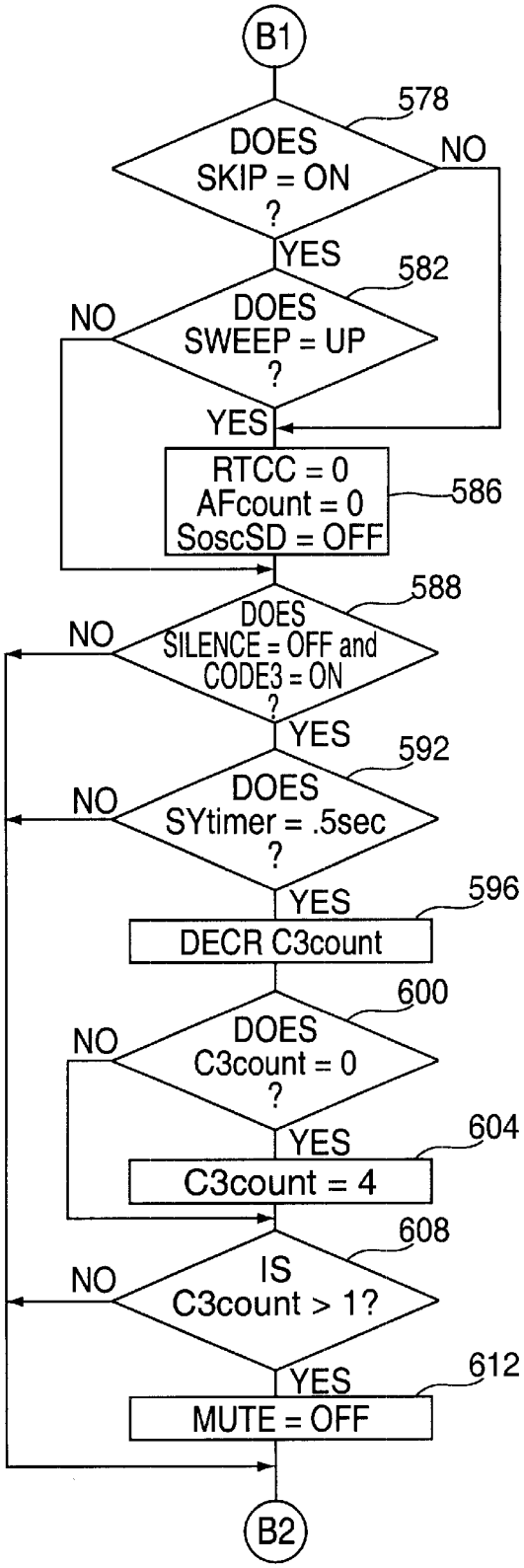
Figure 4E:
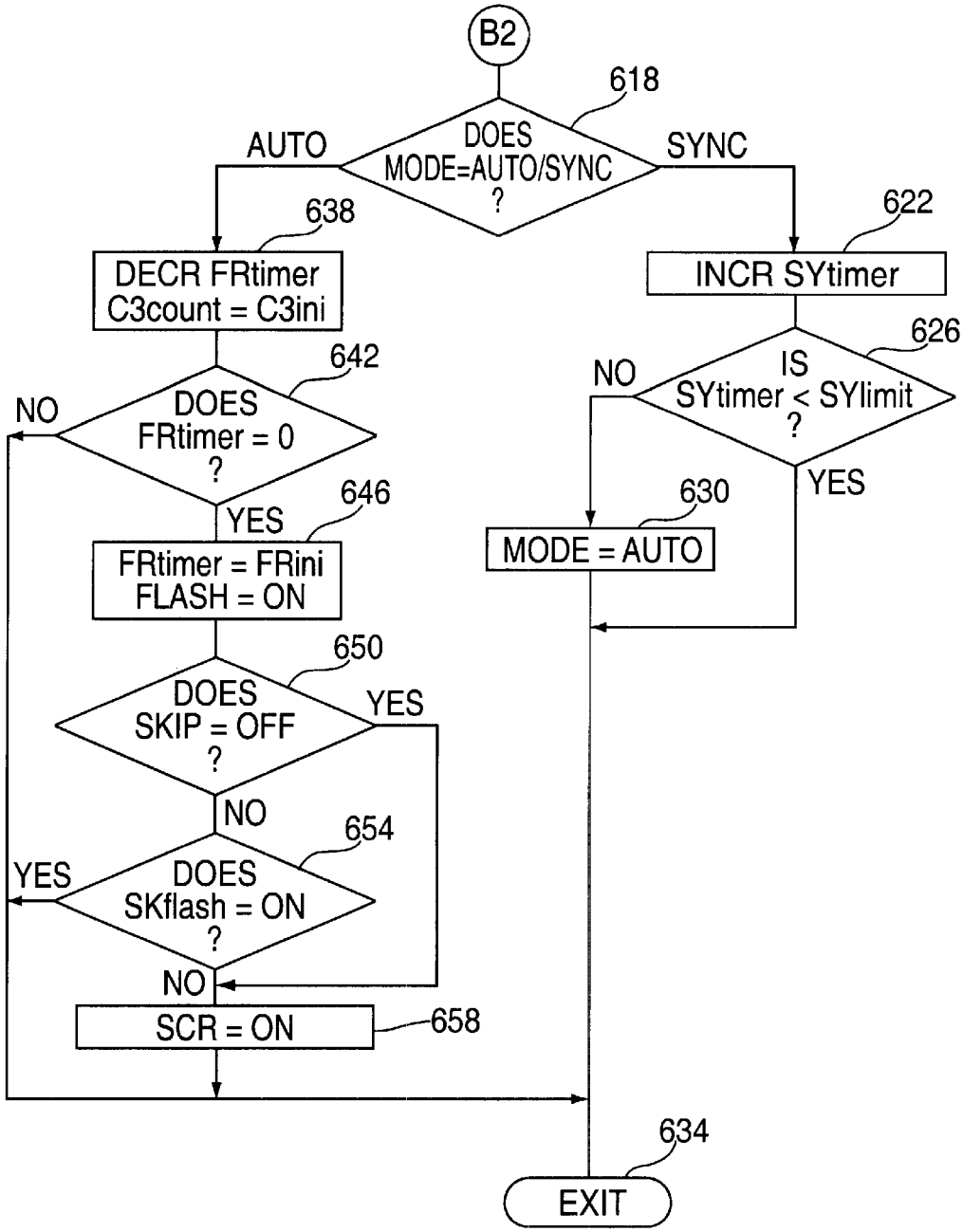

Now, turning to FIGS. 4C, 4D and 4E, which represents the flowchart for Control Program No. 2, the program checks at block 530 to see if the "FLASH" function has been activated. If not, at block 578, SCR Q3 of the alarm unit is turned off via pin 1 of the microcontroller and the next several program functions relating to determination of the input voltage are passed over.

If the "FLASH" function is on, the program, at blocks 538, 542 and 546, checks to see whether the number of drop outs, represented by the variable "DOnmbr", indicates that a FWR input voltage is being used, and the variable "Vin" is set to the appropriate input voltage type, either FWR or D.C.

The next function carried out by the microcontroller software relates to the feature discussed briefly above whereby the alarm unit will compensate for a below-nominal input voltage by lowering the flash frequency. More particularly, when the input voltage is determined to be below 20 volts, the flash frequency will be cut in half to approximately 0.5 Hz, or one flash every two seconds. Determination of the input voltage is accomplished using the variable "Vcount" which, as previously discussed, under certain circumstances is incremented in Control Program No. 1 when the opto-oscillator has not been shut down and the real time clock counter as represented by variable "RTCC" has exceeded "LTvalue".

Before performing this function, however, the program at block 548 checks to see if "SKflash" is off. If not, then the voltage check is passed over and the program proceeds to block 562. If, on the other hand, the current flash is not being skipped, then at block 550 "Vcount" is compared to a predetermined constant, "Vref".

As discussed above, "Vcount" will never be incremented higher than 120 within the time period between flashes, and, if the input voltage is over 20 volts, "Vcount" should be incremented all the way to 120 during each flash cycle. If the input voltage is below 20 volts, "Vcount" should be zero. In the embodiment under discussion, the value of "Vref" is chosen to be 30 which will smooth the switch between flashrates.

If, at block 550, "Vcount" exceeds "Vref", the input voltage is determined to be at least 20 V and the "SKIP" function is deactivated at block 554. If "Vcount" is less than "Vref", the input voltage is determined to be less than 20 V and the "SKIP" function is turned on at block 558. After the comparison, "Vcount" is reset to zero and the "FLASH" function is turned off at block 562.

Next, at block 566, the program determines whether the "SKIP" function is on. If so, "SKflash" is toggled at block 570. If not, "SKflash" is turned off at block 574. At block 578 (All FIG. 4D), the program again checks whether the "SKIP" function is on. If not, the program resets "RTCC" and "AFcount" to zero and turns off "SoscSD" at block 586. If "SKIP" is on, then block 582 ensures that block 586 will be executed only if the horn frequency is currently being swept upward.

The software continues at block 588 which determines whether the "SILENCE" function is off and the "CODE 3" function is on. If not, the program skips the next function, which is maintenance of the Code 3 horn signal, and goes directly to block 618. If the conditions are met at block 588, the time since the last sync pulse, represented as "SYtimer", is checked at block 592. If it is equal to 0.5 seconds, then the variable "C3count", which keeps track of the sync pulses in each Code 3 signal cycle, is decremented at block 596.

Figure 7A:
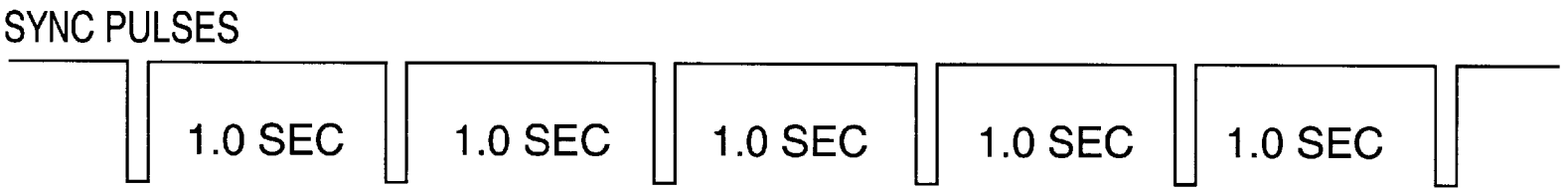
FIGS. 7A and 7B are diagrams showing the relationship between the system sync signal and the audio alarm signal of one embodiment of the present invention.
Figure 7B:
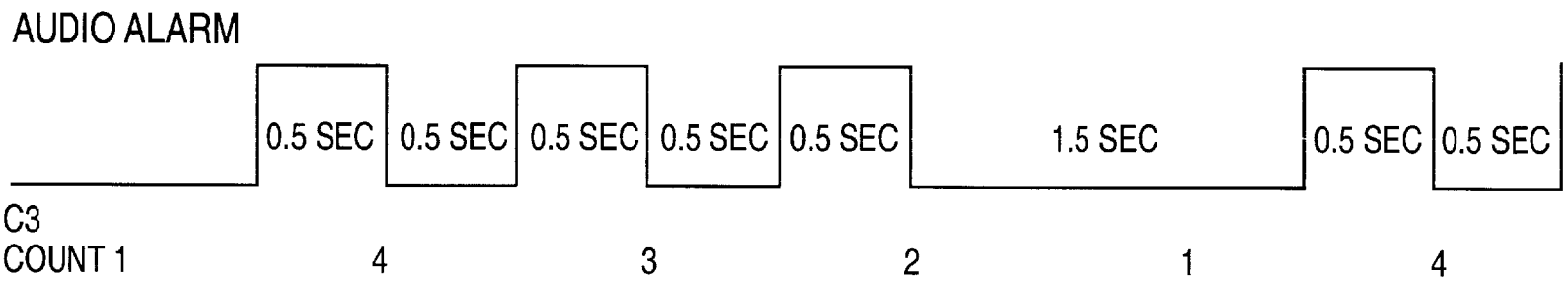

The relationship among "C3count", the sync pulses and the audio Code 3 horn signal is shown in FIGS. 7A and 7B. Each sync pulse triggers one-half second of silence followed by a one-half second horn blast, except when "C3count"=1. During that sync cycle, the horn blast is muted.

After decreasing "C3count", the program checks at block 600 to see if "C3count" is zero. If not, block 604, which sets "C3count" to 4, is skipped. Next, block 608 checks to see if "C3count" is greater than 1. If so, the "MUTE" function is turned off at block 612. If not, block 612 is skipped and the program moves to the next task.

At block 618 (All FIG. 4E), the program checks which mode the system is currently in, auto or sync. If it is in sync mode, "SYtimer" is increased at block 622. Block 626 compares "SYtimer" to the predetermined maximum time, "SYlimit", at which the system should be allowed to continue in the sync mode. If "SYtimer" is not less than "SYlimit", then there is a problem with the sync pulses and the mode is switched to auto at block 630. If not, the mode is left at sync and Control Program No. 2 is exited at block 634.

If the system is in auto mode, that is, the alarm units are operating independently of one another, "FRtimer", a variable which keeps track of the time since the last flash when in the auto mode, is decremented at block 638 and "C3count" is set to its initial value, "C3ini". At block 642, if "FRtimer" is not down to zero, Control Program No. 2 is exited. If "FRtimer" is zero, it is set to its initial value, "FRini", at block 646, and the "FLASH" function is turned on. Then, block 650 checks to see if the "SKIP" function is off. If not, block 654 checks to see if "Skflash" is on. If "SKflash" is on then control program No. 2 is exited. If not, the program flashes the strobe at block 658 by turning on SCR Q3. Returning to block 650, if the "SKIP" function is off, the program jumps to block 658 which flashes the strobe and exits.

Figure 5:
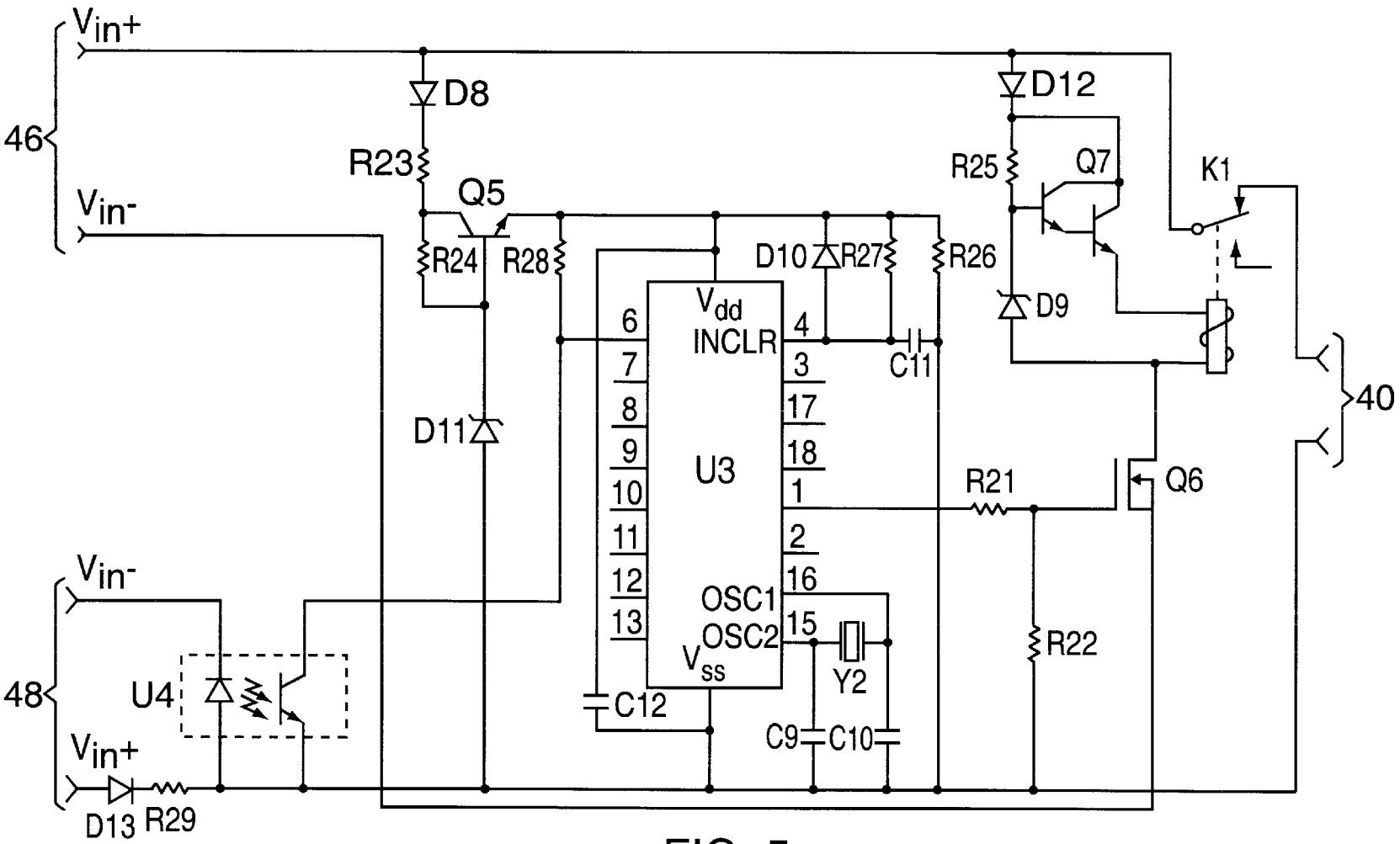
FIG. 5 is a circuit diagram of one embodiment of the interface control circuit of the present invention.

Turning now to the interface control circuit 44 of the invention, the preferred embodiment is shown in FIG. 5 connected across a D.C. voltage source which supplies a voltage Vin. The input voltage enters the interface via the primary loop 46 and normally passes through single pole single throw relay K1 and out of the interface to the system control loop 40. The D.C. voltage source is typically housed in the fire alarm control panel 25 and $V_{in}$ is nominally 24 volts. As discussed above, this voltage may have a wide range of values and the present invention can compensate for unexpected drops in voltage below what is necessary to operate the system at the flash rate of 1.02 Hz noted above.

The supply voltage $V_{in}$ is also applied through a diode D8, which typically has a voltage drop of 0.7 volts, to a regulator circuit which includes resistors R23 and R24, a transistor Q5 and Zener diode D11 connected as shown, with values chosen so as to provide a regulated 5.00 volts ±5% volts to the $V_{dd}$ input of microcontroller U3. Resistor R23 is between the cathode of diode D8 at one end and both the resistor R4 and the collector of transistor Q5 at the other end. The other end of R4 is connected to the base of transistor Q5. A capacitor C12 connected across the $V_{dd}$ and $V_{ss}$ terminals of U3 acts as a filter.

Resistors R26 and R27, capacitor C11 and diode D10 comprise a reset circuit for microcontroller U3. Resistor R27 is connected at one end to the emitter of transistor Q5, the cathode of diode D10 and resistor R26, and at the other end to the "MCLR" terminal 4 of microcontroller U3, the positive terminal of capacitor C11 and the anode of diode D10. The other end of resistor R26 is connected to the negative terminal of capacitor C11. Resistor R28 is connected between the emitter of transistor Q5 at one end and terminal 6 of microcontroller U3 and optocoupler U4 at the other end, to provide a control input to microcontroller U3 for any one or more desired functions.

Oscillations at a frequency of 4 MHz are applied to terminals OSC1 and OSC2 of the microcontroller by a clock circuit consisting of a resonator Y2 and a pair of capacitors C9 and C10 connected between the first and second oscillator inputs, respectively.

In the preferred embodiment, the secondary loop 48 is used as an input for control signals. In the example under discussion, the control signals relate to the "SILENCE" feature which turns off the audio alarm in each of the alarm units while allowing the visual alarm to continue. The secondary loop 48 may also be used to provide an audio alarm control signal from the fire alarm control panel to the multiple alarm units. The latter function is implemented where the fire alarm system is already equipped with the capability to provide a desired alarm sequence, Code 3 in the preferred embodiment, and provides the necessary control signals to the system. In the case where the system does not have Code 3 capabilities, the interface unit can be programmed to provide the Code 3 control signals to the alarm units as will be described hereinbelow.

The secondary input loop 48 of the interface control circuit is connected across a D.C. source. An input from the control panel will be in the form of a power interrupt, or "drop out", which is detected by the microcontroller U3 at pin 6. Normally, voltage is applied at the secondary loop across the series connection of diode D13, resistor R29 and optocoupler U4. The LED of U4 turns on the transistor of U4 thereby causing current to flow through R28 and a low voltage at pin 6 of microcontroller U3. Interruption of the D.C. source will turn off the transistor of U4 and pull pin 6 of U3 to $V_{dd}$ or 5V.

The direct connection from the primary loop input 46 to the control loop output 40 may be interrupted by activating the relay K1 which is accomplished by turning on switch Q6. Switch Q6 is turned on by an output of microcontroller U3 which is applied to the gate of switch Q6 via a voltage divider including a resistor R21 connected from output pin 1 of microcontroller U3 to the gate, and a resistor R22 connected from the gate electrode to the negative side of the power source.

When Q6 is closed, the potential at the output emitter of switch Q7, which preferably comprises a Darlington pair, is pulled to that of the negative side of the power source, causing Q7 to conduct. The voltage applied to the base electrode of one transistor of the Darlington pair Q7 is regulated by a resistor R25 and a Zener diode D9 in a series connection between the cathode of diode D12 and the end of the coil of relay K1 that is connected to switch Q6. When Q7 conducts, current flows through the coil of relay K1 and switches the relay from its normal position to the other contact. Actuation of the relay causes an interruption of the D.C. voltage normally supplied to the controlled alarm units.

The power drop outs can be used for any one of a number of control functions, "silence" being the example provided. Under the scheme discussed above, commands based on the position of sync/control pulses are sent to each alarm unit simultaneously. A more flexible alternative to pulse position coding is pulse train binary coding. One skilled in the art will appreciate that with a pulse train of, for example, eight pulse positions, several positions in the train can be assigned to the task of addressing commands to individual alarm units. One can envision circumstances where this would be advantageous, such as where one seeks to deactivate alarms on a particular floor while allowing the alarms to continue on others.

The interface control circuit 44 is capable of operating in three different modes. Which one of the three modes it will operate in depends on the capabilities of the existing system. The interface control circuit will operate in mode 1 in a system which is not equipped with Code 3 or silence capabilities. For mode 1 operation, the interface control circuit is installed with the primary loop, and the Code 3 signaling is performed by the interface control circuit as described earlier, not the fire alarm control panel. In mode 1, a silence feature is not available.

Mode 2 is used where the existing system has a silence feature, but not a Code 3 capability. In that case, the interface control circuit is installed with both a primary and secondary input loop, the secondary input loop being available for a silence signal from the control panel. As in mode 1, Code 3 is performed by the interface control circuit.

Finally, mode 3 is available for systems which already have Code 3 and silence function capabilities. Here, the interface control circuit is installed with both a primary and secondary input loop. The Code 3 control signal originates in the control panel as does the silence control signal.

By way of example, the interface control circuit under discussion and shown in FIG. 5, when energized from a 24 volt D.C. power source, may use the following parameters:

| ELEMENT | VALUE OR NUMBER |
|---|---|
| C9, C10 | CAP., 33 pF |
| C11 | CAP., .47 μF |
| C12 | CAP., 15 μF, 16 V |
| D8 | DIODE, 1N4007 |
| D9 | DIODE, 1N5236, 7.5 V |
| D10 | DIODE, 1N914 |
| D11 | DIODE, 1N4626 |
| D12 | DIODE, 1N4007 |
| D13 | DIODE, 1N4007 |
| K1 | RELAY, SPST |
| Q5 | TRANSISTOR, 2N5550 |
| Q6 | TRANSISTOR, 1RF710 |
| Q7 | TRANSISTORS, T1P122 |
| R21 | RES., 220 |
| R22 | RES., 100 K |
| R23 | RES., 330 |
| R24 | RES., 4.7 K |
| R25 | RES., 4.7 K, ½ W |
| R26 | RES., 10 K |
| R27 | RES., 39 K |
| R28 | RES., 10 K |
| R29 | RES., 2.7 K, ½ W |
| U3 | MICROCONTROLLER, PIC16C54 |
| U4 | OPTOCOUPLER, 4N35 |
| Y2 | CERAMIC RES., 4 MHZ |

The microcontroller U3 of the interface control circuit of FIG. 5 is responsible for closing switch Q6 and thus transmitting power drop outs which will be interpreted by the alarm units as described earlier.

Figure 6:
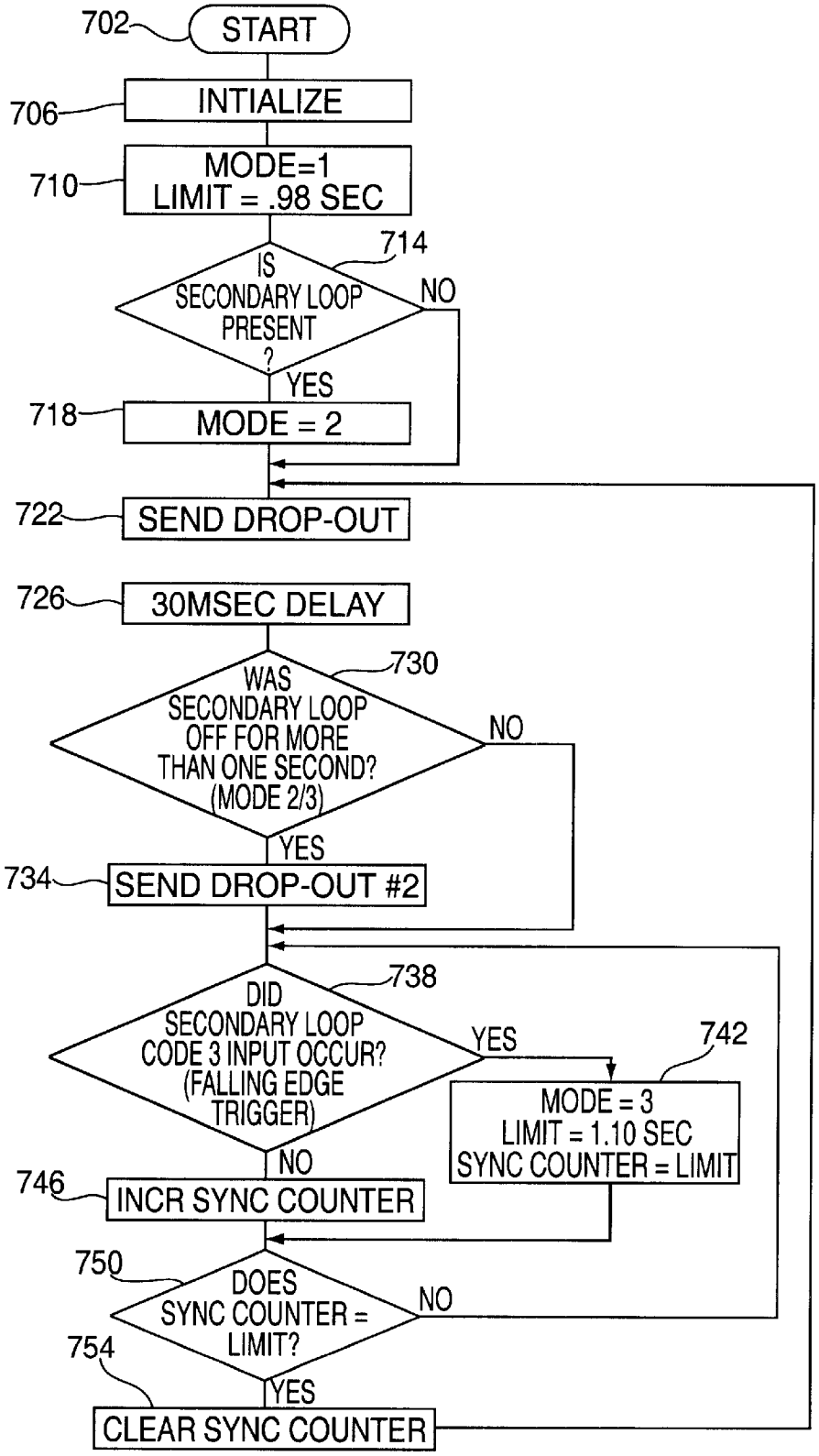
FIG. 6 illustrates the software routine of the microcontroller of the interface control circuit shown in FIG. 5.

FIG. 6 illustrates the software routine of the microcontroller U3. At blocks 702 and 706, the program begins and is initialized. At block 710, mode 1 is assumed and the sync period limit is set to 0.98 seconds. Block 714 is an inquiry as to whether the secondary loop is present in the alarm system. If so, at block 718, the mode is set to mode 2. At blocks 722 and 726, a drop out of 30 msec duration which acts as the sync pulse is sent on the output control loop. Where the system is operating in either mode 2 or 3, the program inquires at block 730 as to whether there has been an interrupt in power of more than one second to the secondary loop, which would indicate a silence signal from the control panel. If so, at block 734 a second "drop out" is sent to the alarm units almost immediately. Although not shown in FIG. 6, one skilled in the art will appreciate that the silence feature can be similarly deactivated by another input of significant duration to the secondary loop after which a dropout in the third pulse position, for example, is sent to the interface control circuit.

Next, at block 738, the program looks for an input indicative of Code 3 from the control panel on the secondary loop. If one is detected, block 742 sets the mode number to 3, sets the sync period limit to 1.10 seconds and sets the sync counter to the limit, 1.10 seconds. This slight increase in the sync period ensures proper Code 3 operation when Code 3 signals are originating from the control panel 25 rather than the interface control circuit 44. If the Code 3 input is not detected, the sync counter is incremented at block 746. Next, at block 750, the program looks at whether the sync counter has reached the set limit. If so, the program clears the sync counter at block 754 and loops back to block 722, thereby sending a drop out. If the limit has not been reached, the program loops back to block 738.

Figure 9:
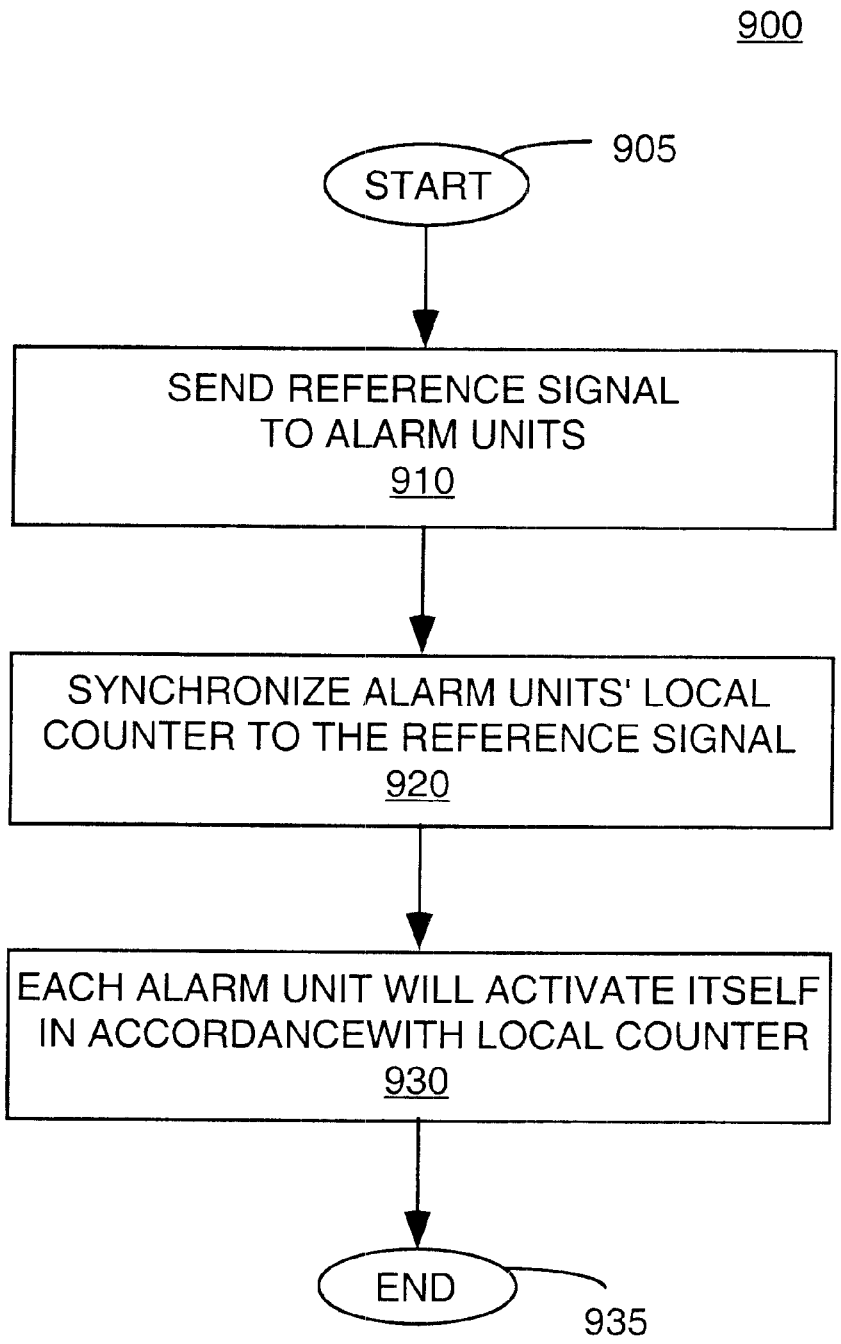
FIG. 9 illustrates a flowchart of a method for synchronizing a plurality of alarm units while reducing the number of synchronization pulses that are transmitted to the alarm units.

FIG. 9 illustrates a flowchart of a method 900 for synchronizing a plurality of alarm units while reducing the number of synchronization pulses that are transmitted to the alarm units, thereby increasing the reliability of the overall alarm system. More specifically, the synchronization method as discussed above in FIGS. 4A–4E effects synchronization of all the alarm units by employing an interface control circuit to send synchronization pulses to the alarm units. Upon receipt of each synchronization pulse, the alarm units will flash in synchronization.

Although the above synchronization method is effective, the reliability of the overall alarm system can be increased if the number of transmitted synchronization pulses (transmission rate) is reduced. Namely, since the interface control circuit employs a relay that is activated for each synchronization pulse, the reliability of the interface control circuit can be increased if the duty cycle of the relay is reduced.

Returning to FIG. 9, method 900 starts in step 905 and proceeds to step 910 where a reference synchronization signal is sent to the alarm units from the interface control circuit. This reference synchronization signal is used by each alarm unit in step 920 to set or synchronize its local counter (or a clock). Each alarm unit will then activate itself (flash and/or sound horn) in accordance with the local counter. In other words, the reference synchronization signal does not directly cause the alarm units to activate, but instead provides an accurate time reference from which each alarm unit will generate one or more flashes, thereby reducing the total number of transmitted reference synchronization signals.

Method 900 then ends in step 935. Method 900 is further described in detail below in FIGS. 10–14.

Figure 10:
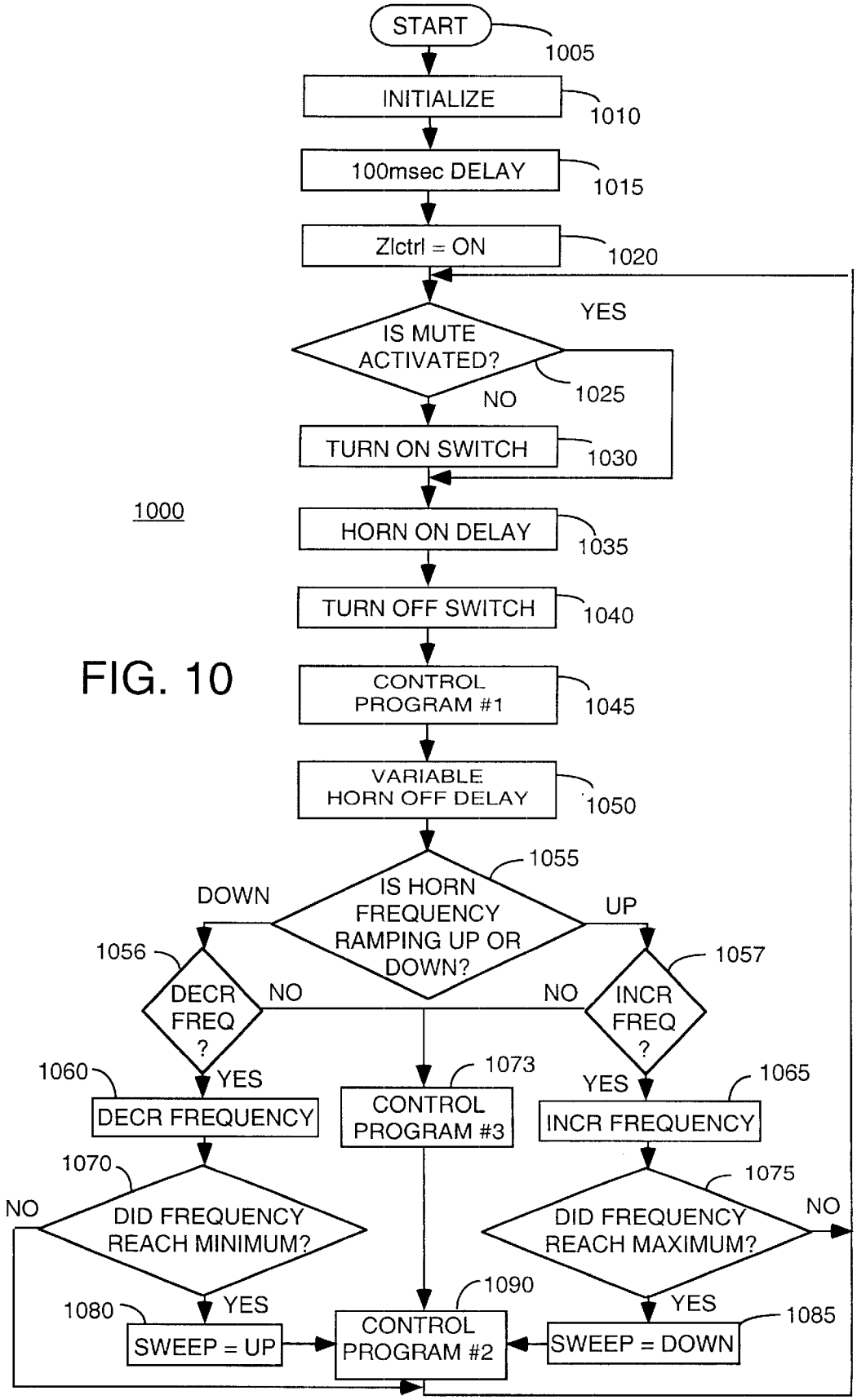
FIG. 10 illustrates a flowchart of an alternate embodiment of a software routine of the main program of the microcontroller of the alarm unit as shown in FIG. 3 and FIG. 8.

FIG. 10 illustrates a flowchart of an alternate embodiment of a software routine or method of the microcontroller of the alarm units as shown in FIG. 3 and FIG. 8. More specifically, method 1000 starts in step 1005 and proceeds to step 1010 where initialization is performed, e.g., one or more registers and variables are initialized.

In step 1015, method 1000 generates a delay, preferably 100 milliseconds (msec.). Namely, a delay is generated at the alarm unit during which time the switch Q6 is off and the resistors R5 and R27 limit the inrush condition as shown in FIG. 8.

In step 1020, zero-inrush control (ZIctrl) is turned "ON". More specifically, the switch Q6 is turned on, thereby redirecting the current through Q6 and around the resistor R27 as shown in FIG. 8.

In step 1025, method 1000 queries whether the horn is currently being muted (represented by the variable or flag "MUTE"), as in the case if the Code 3 signal is in one of the half-second or one and one-half second silence periods, or if the "SILENCE" feature has been activated. If the query is affirmatively answered, then method 1000 proceeds to step 1035. If the query is negatively answered, then method 1000 proceeds to step 1030, where the microcontroller U1 of the alarm unit will turn on the horn (turn on switch) by sending out a high signal from the microcontroller to turn on switch Q1 as shown in FIGS. 3 and 8.

In step 1035, method 1000 generates a "Horn On Delay". Namely, as discussed above, the horn is programmed to have a varying frequency, e.g., between 3,200 and 3,800 Hz, for simulating an actual horn. Thus, the "Horn On Delay", e.g., 0.120 msec., can be selectively set to control the frequency of the horn. However, in the preferred embodiment, the "Horn On Delay" is held as a constant, whereas the "Horn Off Delay" is varied as discussed below.

In step 1040, method 1000 turns off the horn (turn off switch). More specifically, the horn is turned off by turning off switch Q1 as shown in FIGS. 3 and 8.

In step 1045, method 1000 executes Control Program No. 1. In brief, Control Program No. 1 is responsible for the detection and interpretation of the voltage drop outs, which serve as reference synchronization or control pulses or signals (hereinafter "sync/control pulses") to the alarm units, and is described in detail below in FIG. 11. Additionally, Control Program No. 1 is also responsible for the detection of proper charging of the capacitor C4 that provides the charge to flash the flashtube DS1.

In step 1050, method 1000 generates a variable "Horn Off Delay". As discussed above, the "HORN OFF DELAY" time is varied to better simulate an actual horn sound. Namely, a counter value is varied.

In step 1055, method 1000 queries whether the horn frequency is ramping up or ramping down. If the horn frequency is ramping down, method 1000 proceeds to step 1060, where the horn frequency is decreased to the next step, e.g., three (3) micro seconds ($\mu$sec.). If the horn frequency is ramping up, method 1000 proceeds to step 1065, where the horn frequency is increased to the next step, e.g., three (3) microseconds ($\mu$sec.).

However, since horn frequency is changed every other cycle, method 1000 incorporates two queries 1056 and 1057, which inquire whether the horn frequency should be decreased or increased in the present cycle respectively. If the query is affirmatively answered, then method 1000 will either decrease or increase horn frequency in steps 1060 and 1065 respectively. If the query is negatively answered, then method 1000 proceeds to step 1073 where Control Program No. 3 is executed as discussed below in FIG. 14.

In step 1070, method 1000 queries whether the horn frequency has reached the minimum horn frequency. If the query is negatively answered, then method 1000 proceeds to step 1025, where the loop of method 1000 is repeated. If the query is positively answered, then method 1000 proceeds to step 1080, where the variable "Horn Off Delay" is toggled to sweep up for the next cycle. Namely, the horn frequency has been decreased to a predefined point, e.g., 3,200 Hz and will be ramped up on the next cycle.

Similarly, in step 1075, method 1000 queries whether the horn frequency has reached the maximum horn frequency. If the query is negatively answered, then method 1000 proceeds to step 1025, where the loop of method 1000 is repeated. If the query is positively answered, then method 1000 proceeds to step 1085, where the variable "Horn Off Delay" is toggled to sweep down for the next cycle. Namely, the horn frequency has been increased to a predefined point, e.g., 3,800 Hz and will be ramped down on the next cycle.

In step 1090, method 1000 executes Control Program No. 2. In brief, Control Program No. 2 is responsible for the detection of low input voltage. Namely, if the input voltage falls below a preferred level, the flash rate of the flashtube can be reduced to maintain optimal brightness.

Additionally, Control Program No. 2 is also responsible for the maintenance of various counters. First, these counters are used to detect the absence of a reference synchronization pulse. Failure to receive a reference synchronization pulse within a predefined time limit will cause the alarm unit to enter into automatic mode, where the activation of the flashtube and/or the horn are locally controlled without the need of reference synchronization pulses. Second, these counters are also used to implement the Code 3 pattern as discussed below.

Figure 11:
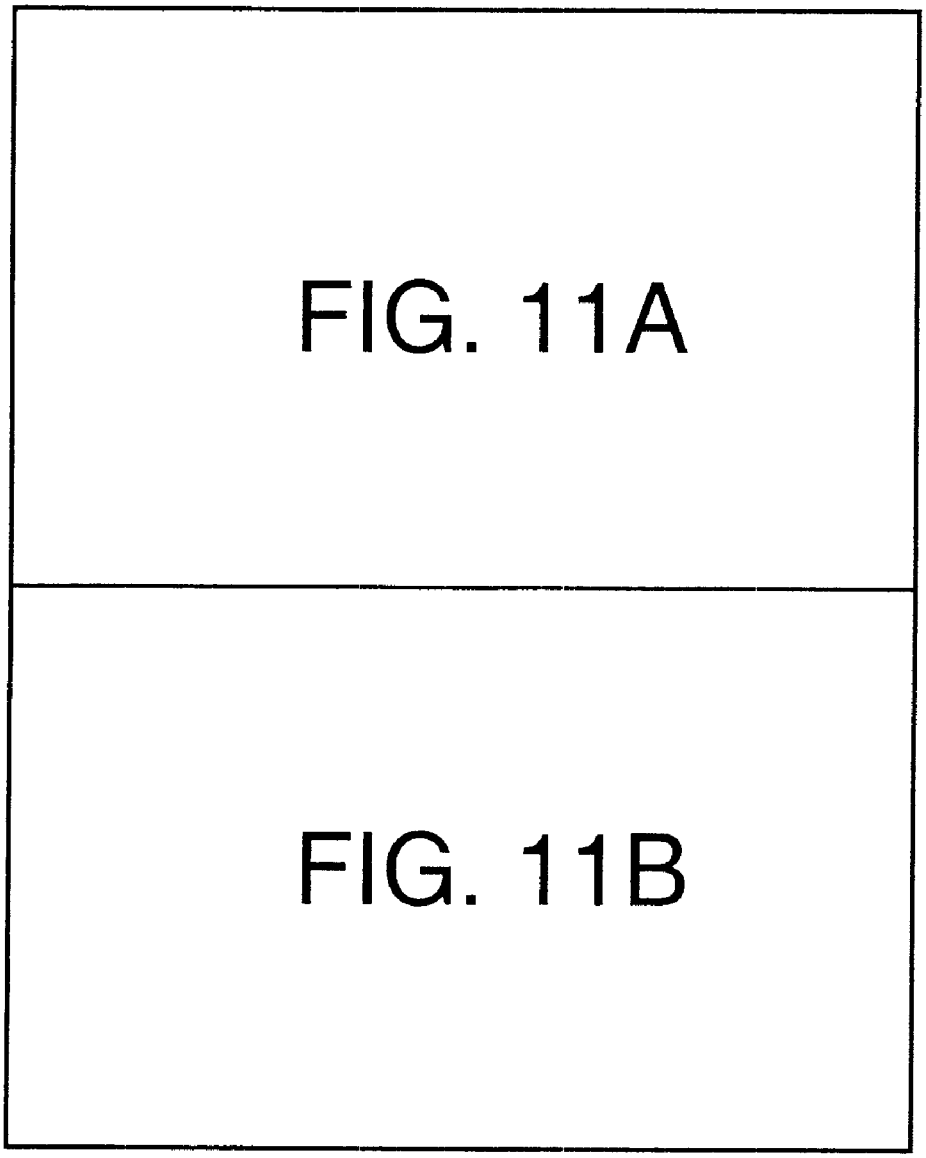
FIG. 11, FIG. 11A, AND FIG. 11B illustrate a flowchart of Control Program No. 1 of FIG. 10.
Figure 11A:
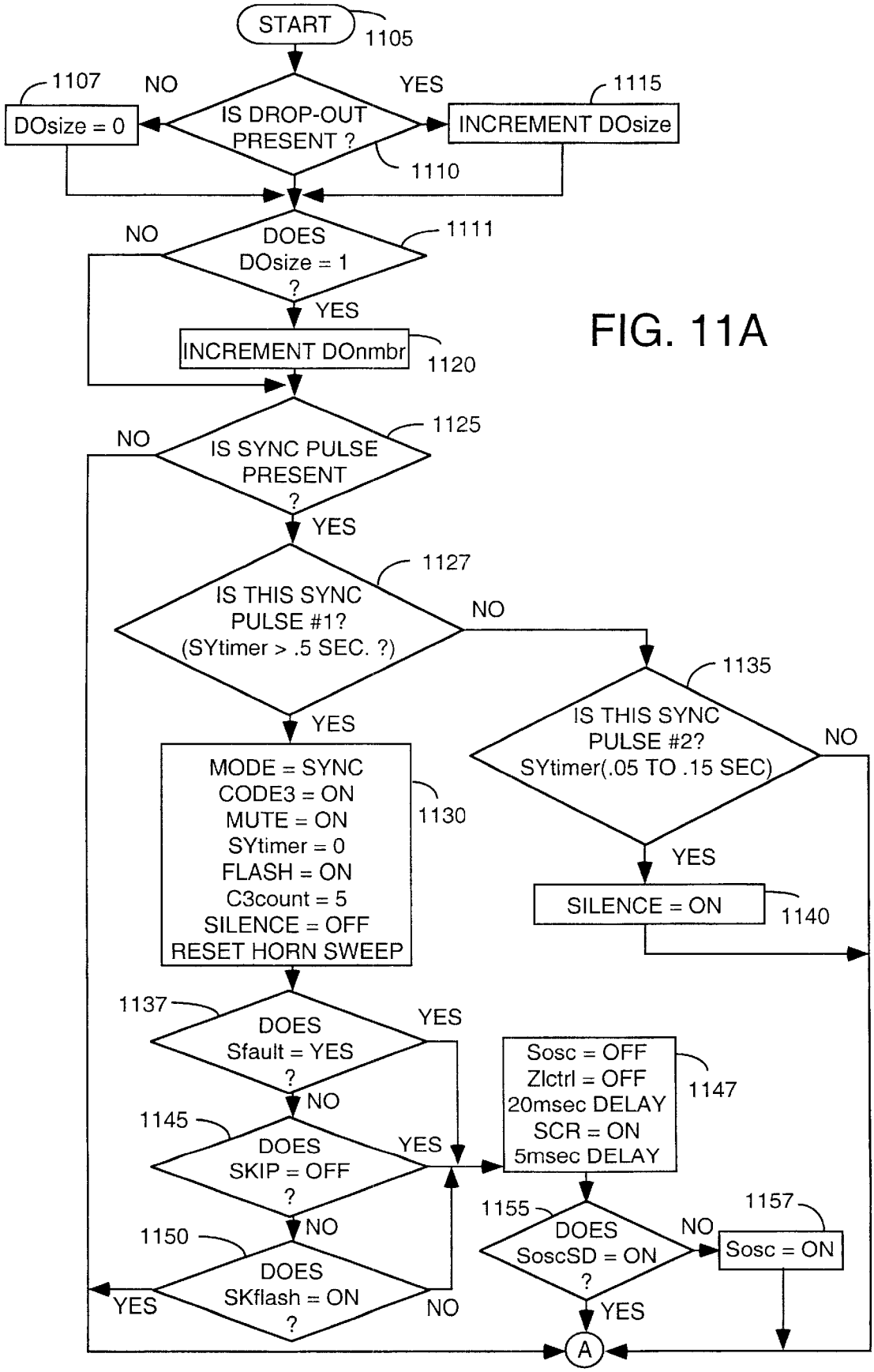
Figure 11B:
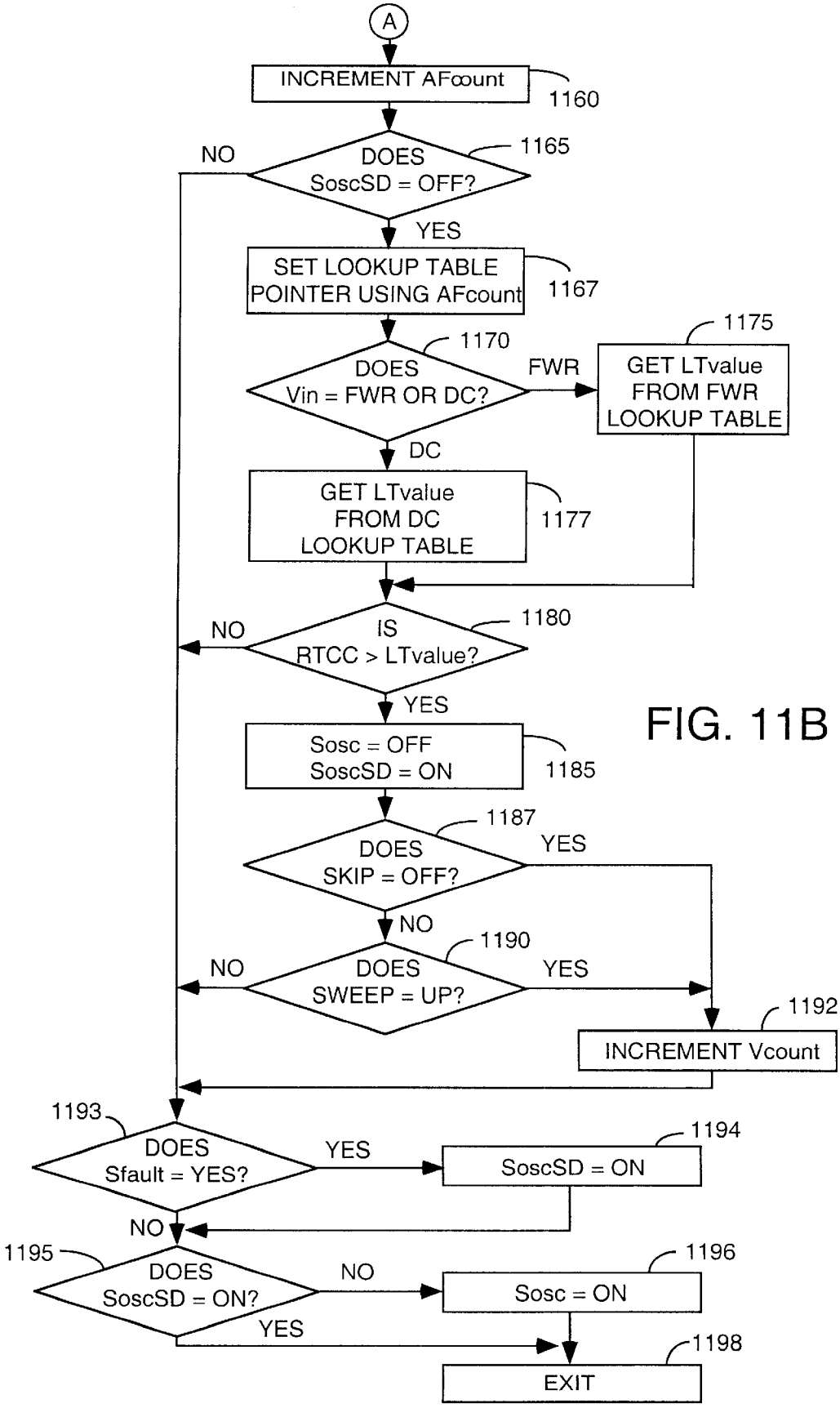
Figure 12:
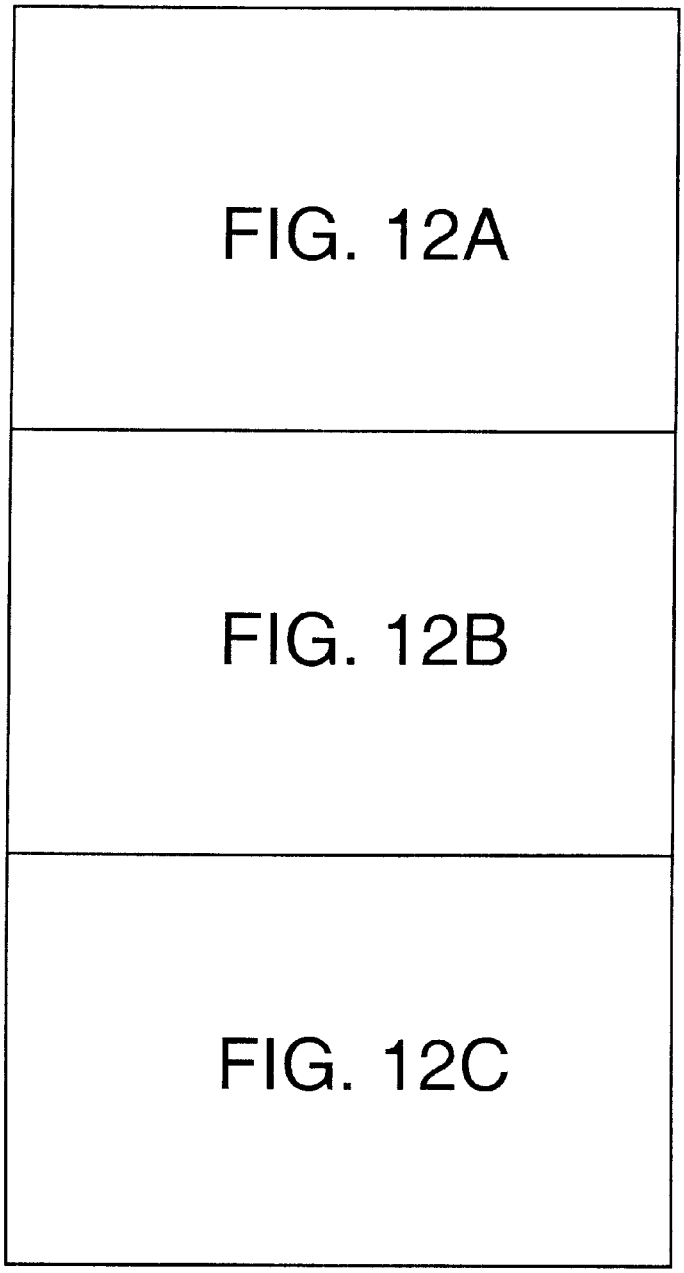
FIG. 12, FIG. 12A, FIG. 12B and FIG. 12C illustrate a flowchart of Control Program No. 2 of FIG. 10.
Figure 12A:
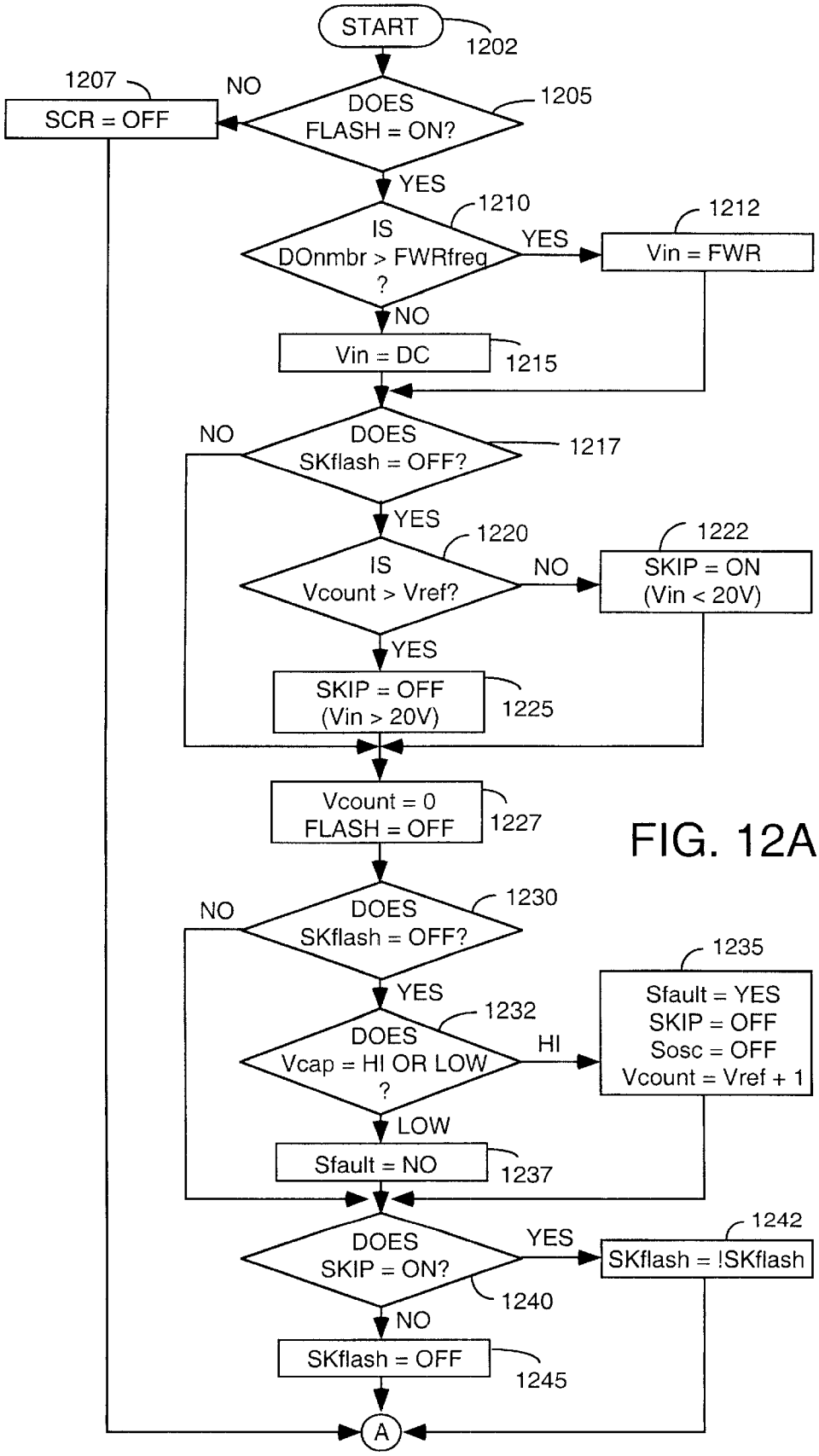
Figure 12B:
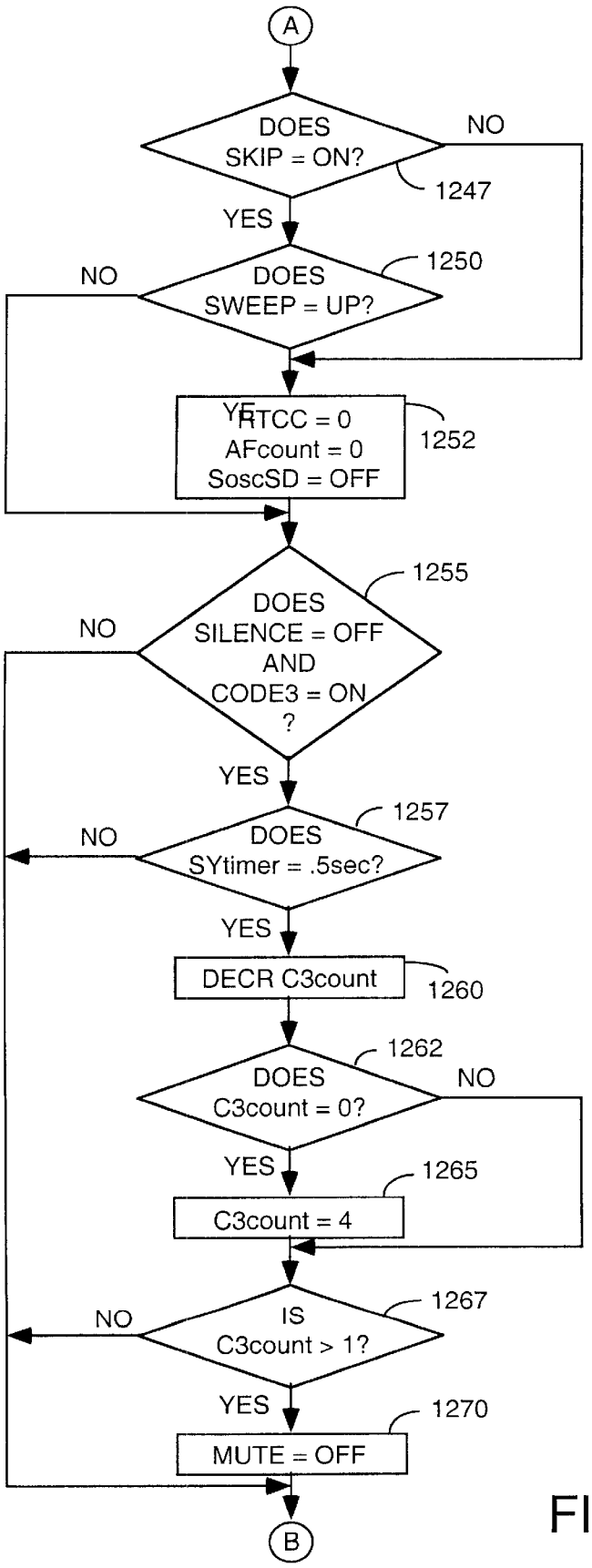
Figure 12C:
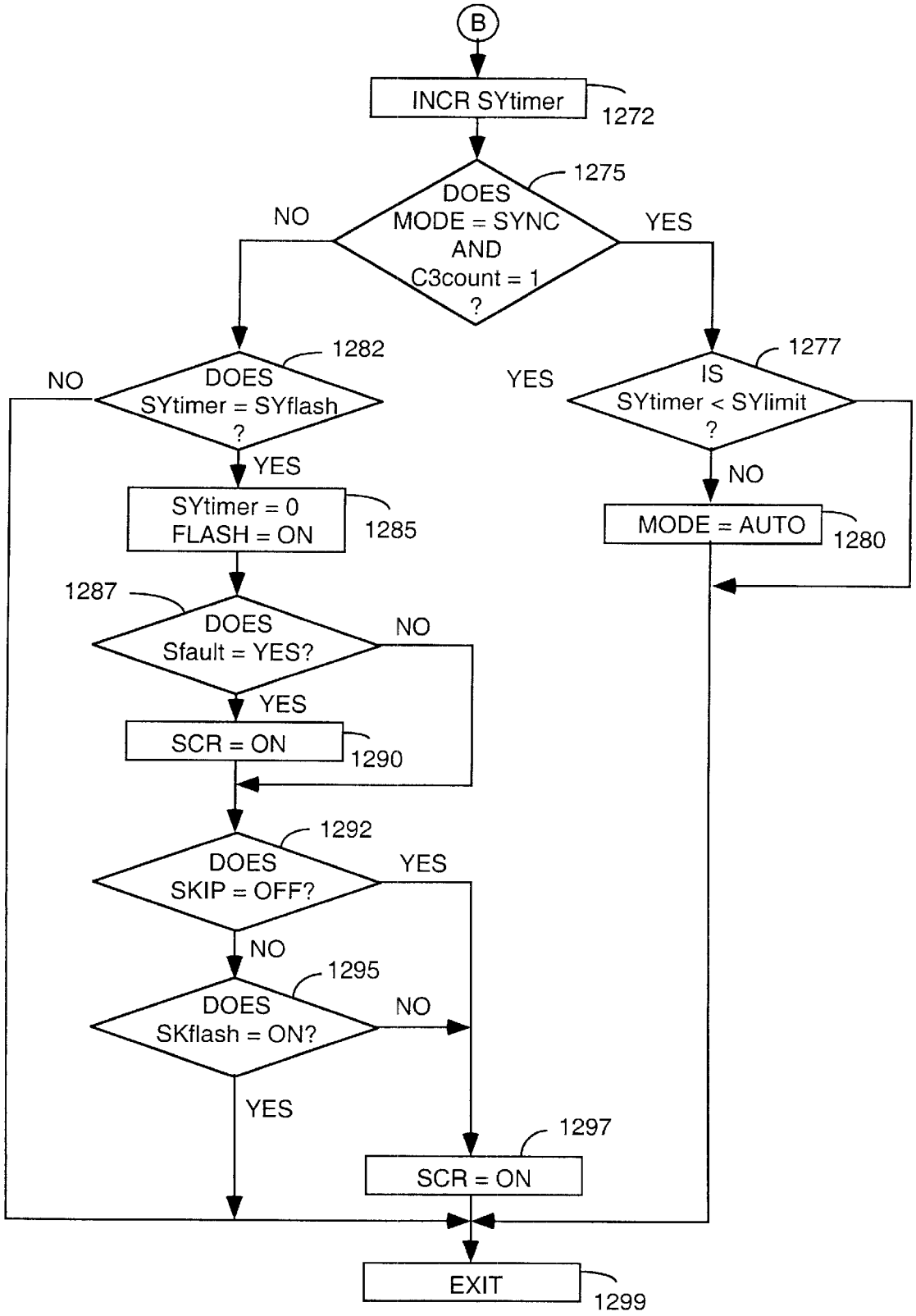

FIG. 11, FIG. 11A, and FIG. 11B illustrate a flowchart of Control Program No. 1 (step 1045) of FIG. 10. Namely, FIG. 11, FIG. 11A, and FIG. 11B illustrate a method 1100 for detecting and interpreting voltage dropouts.

More specifically, method 1100 starts in step 1105 and proceeds to step 1110, where method 1100 queries whether a voltage drop-out is present. If the query is affirmatively answered, then method 1100 proceeds to step 1115, where a counter "DOsize" is incremented. Namely, method 1100 is checking the input voltage which is typically set at 24 volts. Detection of the leading edge of a drop out initiates a counter "DOsize", such that a voltage drop-out greater than five (5) msec. constitutes the presence of a voltage drop-out. If the query is negatively answered, then method 1100 proceeds to step 1107, where the counter "DOsize" is set to zero "0". Namely, no voltage drop-out is detected so that the counter "DOsize" is reset to zero for the next cycle.

In step 1111, method 1100 queries whether "DOsize" is equal to one ("1"). If the query is affirmatively answered, then method 1100 proceeds to step 1120, where a counter "DOnmbr" is incremented. Namely, the counter "DOnmbr" keeps track of the number of drop outs. If the query is negatively answered, then method 1100 proceeds to step 1125.

In step 1125, method 1100 queries whether a reference synchronization pulse is present. Namely, method 1100 is determining if the drop out is sufficiently wide to constitute a sync/control pulse. If the query is affirmatively answered, then method 1100 proceeds to step 1127. If the query is negatively answered, then method 1100 proceeds to step 1160.

In step 1127, method 1100 queries whether the detected sync/control pulse is greater than 0.5 seconds, e.g., relative to a previously received sync/control pulse. Namely, the time of detecting the sync/control pulse is stored in the counter "Sytimer" and this stored value is compared to the threshold value of 0.5 seconds. It should be noted that the "SYtimer" can be reset for every strobe flash or for every reception of the sync/control pulse.

Namely, method 1100 is determining if the present sync/control pulse is a first or a second pulse. According to the present invention, the first pulse indicates the beginning of a new synchronization cycle or sync cycle. By way of example, the presence of a second pulse immediately following the first sync pulse activates the "SILENCE" feature throughout the alarm system and turns off any audio alarm which may be sounding. Namely, if the present sync/control pulse is a first pulse then it is a reference synchronization pulse. If the present sync/control pulse is a second pulse, then it is a control pulse for the "SILENCE" feature. Thus, if the query in step 1127 is affirmatively answered, then method 1100 determines that the present sync/control pulse is a reference synchronization pulse and proceeds to step 1130. If the query in step 1127 is negatively answered, then method 1100 proceeds to step 1135.

In step 1135, method 1100 queries whether the detected sync/control pulse is between a range of 0.05 to 0.15 second relative to a previously received sync/control pulse. If the query is affirmatively answered, then method 1100 proceeds to step 1140, where the "SILENCE" feature is turned "On". If the query is negatively answered, then method 1100 proceeds to step 1160.

In step 1130, method 1100 sets several functions or variables. First, the operational mode of the alarm unit is set to "SYNC" mode, where the operation of the alarm unit will be controlled by sync/control pulses. Second, if the alarm unit has Code 3 capability, then the Code 3 pattern is activated. Third, "MUTE" is turned "ON", i.e., upon reception of a reference synchronization pulse, a period of silence is provided, e.g., the start of a Code 3 pattern. Fourth, the counter "SYtimer" is reset to zero (0). Fifth, a flash control bit, "Flash" is set to "ON". Sixth, the counter "C3count" is initialized to 5. Seventh, a silence control bit, "Silence" is set to "OFF". Finally, the HORN SWEEP is also reset to its starting position, e.g., 3600 Hz.

In step 1137, method 1100 queries whether the variable, "Sfault", is set to "Yes". Namely, "Sfault" is set to "Yes" when a strobe fault, e.g., a high post trigger voltage, is detected by the microcontroller of the alarm unit. If the query is affirmatively answered, then method 1100 proceeds to step 1147. If the query is negatively answered, then method 1100 proceeds to step 1145.

In step 1145, method 1100 queries whether the function, "SKIP", is set to "Off". Namely, the function "SKIP" allows the alarm unit to selectively skip one cycle of flash, i.e., altering the flash rate of the alarm unit. In the present invention, skipping a flash is optionally provided when it is determined that the input voltage is below an acceptable level. Such low input voltage may affect the brightness of the flashes produced by the flashtube. As such, it is desirable to reduce the flash rate, e.g., from one flash per second to one flash per two seconds, when a low input voltage condition, e.g., below 20V, is detected, thereby ensuring that each flash meets a minimum criterion as to brightness. If the query is affirmatively answered, then method 1100 proceeds to step 1147. If the query is negatively answered, then method 1100 proceeds to step 1150.

In step 1150, method 1100 queries whether the variable or bit, "SKflash", is set to "On". This variable is used to record the current state as to whether a flash should be skipped. Namely, when the "SKIP" function is activated, the variable "SKflash" is toggled between "On" and "Off"once each flash cycle causing every other flash to be skipped. Thus, if the query is affirmatively answered, then method 1100 proceeds to step 1160. If the query is negatively answered, then method 1100 proceeds to step 1147.

In step 1147, method 1100 sets several functions or variables. First, "Sosc" is set to "Off", where "Sosc" is employed to control the opto-oscillator. By turning off the opto-oscillator, power is further conserved for the flash cycle. Second, "Zlctrl" is optionally set to "Off". Third, a 20 msec. delay is generated. This 20 msec. delay when combined with approximately 5 msec. of time that is used to detect the sync/control pulse, forms the width of a sync/control pulse. At the end of the total 25 msec. of elapsed time, SCR is set to "On", thereby turning on SCR Q3 to trigger a flash. Finally, another delay of 5 msec is provided for the SCR to complete its function, i.e., causing the discharge of a capacitor to provide the necessary energy to generate a flash in the flashtube.

In step 1155, method 1100 queries whether the variable, "SoscSD", is set to "On". The variable "SoscSD" allows the control of the opto-oscillator to be set by a variable or flag. Namely, variable "SoscSD" is indicative of the "oscillator shut down" function, where "SoscSD=On" indicates that the opto-oscillator is shut down. There are certain situations where it is desirable to turn on or off the opto-oscillator as discussed below. Thus, if the query is affirmatively answered, then method 1100 proceeds to step 1160. Namely, the opto-oscillator is left off for the present moment. However, if the query is negatively answered, then method 1100 proceeds to step 1157, where "Sosc" is set to "On".

In step 1160, method 1100 increments the variable or counter "AFcount". "AFcount" is used to count the number of cycles of Control Program No. 1 which corresponds to the audio frequency of the audio alarm signal.

In step 1165, method 1100 queries whether the variable, "SoscSD", is set to "Off". If the query is affirmatively answered, then method 1100 proceeds to step 1167, where a pointer is set in accordance with the value in "AFcount", i.e., based upon how many audio signal cycles have elapsed. However, if the query is negatively answered, then method 1100 proceeds to step 1193.

In step 1170, method 1100 queries whether the input voltage $V_{in}$. is FWR or D.C. If the input voltage is FWR, then method 1100 proceeds to step 1175, where a lookup table value, "LTvalue" is selected from an FWR lookup table. However, if the input voltage is D.C., then method 1100 proceeds to step 1177, where a lookup table value, "LTvalue" is selected from a D.C. lookup table. The lookup table value, "LTvalue", is a predetermined minimum desirable number of cycle counts for the opto-oscillator and is used to determine whether the capacitor C4, which provides the energy to flash flashtube DS1, is charging too quickly.

In step 1180, method 1100 queries whether the variable RTCC is greater than the retrieved "LTvalue". RTCC is implemented as a real time clock counter by the microcontroller to track the number of times the opto-oscillator has cycled. Namely, "LTvalue" is compared to the number of connect/disconnect cycles of the opto-oscillator responsible for charging C4. If RTCC is greater than "LTvalue", then the opto-oscillator is turned off at step 1185 by turning on "SoscSD" and turning off "Sosc". In other words, the charging of capacitor C4 is sufficient such that the opto-oscillator can be turned off. This allows the alarm unit to precisely control the amount of energy stored in the capacitor C4, thereby allowing the alarm unit to maintain a substantially uniform brightness level for each flash.

In step 1187, method 1100 queries whether the function, "SKIP", is set to "Off". If the query is affirmatively answered, then method 1100 proceeds to step 1192, where the variable "Vcount" is incremented. "Vcount" is used to determine whether the alarm unit is receiving a proper input voltage. If the query is negatively answered, then method 1100 proceeds to step 1190.

In step 1190, method 1100 queries whether the horn frequency is ramping up. If the query is affirmatively answered, then method 1100 proceeds to step 1192, where the variable "Vcount" is incremented. If the query is negatively answered, then method 1100 proceeds to step 1193.

In step 1193, method 1100 queries whether the variable, "Sfault", is set to "Yes". Namely, method 1100 is determining if a strobe fault has occurred. If the query is affirmatively answered, then method 1100 proceeds to step 1194, where the variable "SoscSD" is set to "On". If the query is negatively answered, then method 1100 proceeds to step 1195.

In step 1195, method 1100 queries whether the variable, "SoscSD", is set to "On". If the query is affirmatively answered, then method 1100 proceeds to step 1198, where Control Program No. 1 ends and returns to method 1000 of FIG. 10. If the query is negatively answered, then method 1100 proceeds to step 1196, where "Sosc" is set to "On". It should be noted that once "SoscSD" is turned on, it will not be turned off until Control Program No. 2 is executed.

As discussed above, Control Program No. 2 is executed only at the top and bottom of the horn sweep cycles. The number of times this occurs is controlled by the size of the step of the horn frequency increase or decrease. In one embodiment, Control Program No. 2 is executed 120 times each second, one second being the approximate period between flashes. Therefore, the highest value which "Vcount" can attain between flashes is 120. This is also true when the "SKIP" function is activated and the flash period becomes two seconds, i.e., Control Program No. 2 is executed 240 times between flashes, since "Vcount" is allowed to be incremented only if either the "SKIP" function is off in step 1187 or both the "SKIP" function is on and the horn frequency is sweeping up in step 1190.

FIG. 12, FIG. 12A, FIG. 12B and FIG. 12C illustrate a flowchart of Control Program No. 2 (step 1090) of FIG. 10. Namely, FIG. 12, FIG. 12A, FIG. 12B and FIG. 12C illustrate a method 1200 for detecting low input voltage and for maintaining a plurality of counters that are used to detect the absence of a reference synchronization pulse and to implement the Code 3 pattern.

More specifically, method 1200 starts in step 1202 and proceeds to step 1205, where method 1200 queries whether the function "FLASH" is set to "On". If the query is affirmatively answered, then method 1200 proceeds to step 1210. If the query is negatively answered, then method 1200 proceeds to step 1207, where the SCR is turned off. Namely, the SCR Q3 of the alarm unit is turned off.

In step 1210, method 1200 queries whether the counter "DOnmbr" is greater than the FWR frequency, e.g., 120 Hz. If the query is affirmatively answered, then method 1200 proceeds to step 1212, where the $V_{in}$ is interpreted to be FWR. If the query is negatively answered, then method 1200 proceeds to step 1215, where the $V_{in}$. is interpreted to be D.C.

In step 1217, method 1200 queries whether the variable "SKflash" is set to "Off". If the query is affirmatively answered, then method 1200 proceeds to step 1220. If the query is negatively answered, then method 1200 proceeds to step 1227.

In step 1220, method 1200 queries whether the counter "Vcount" is greater than the reference value "$V_{ref}$". If the query is affirmatively answered, then method 1200 proceeds to step 1225, where the "SKIP" function is turned "Off", indicative of a normal input voltage level. If the query is negatively answered, then method 1200 proceeds to step 1222, where the "SKIP" function is turned "On", indicative of an abnormal input voltage level. Namely, the above steps 1217–1225 are executed to detect a below-nominal input voltage. More particularly, if the input voltage is determined to be below a predefined level, e.g., 20 volts, the flash frequency is reduced in half to approximately 0.5 Hz, or one flash every two seconds. Determination of a below-nominal input voltage is accomplished by using the variable "Vcount" which, as previously discussed, is incremented in Control Program No. 1 when the opto-oscillator has been shut down and the real time clock counter, as represented by register "RTCC" has exceeded "LTvalue".

As discussed above, "Vcount" will never be incremented higher than 120 within the time period between flashes, and, if the input voltage is over 20 volts, "Vcount" should be incremented all the way to 120 during each flash cycle. If the input voltage is below 20 volts, "Vcount" should be zero. In the embodiment under discussion, the value of "Vref" is chosen to be 30 which will smooth the switch between flashrates.

In step 1227, method 1220 resets "Vcount" to zero and the "FLASH" function is turned "off".

In step 1230, method 1200 queries whether the variable "SKflash" is set to "Off". If the query is affirmatively answered, then method 1200 proceeds to step 1232. If the query is negatively answered, then method 1200 proceeds to step 1240.

In step 1232, method 1200 queries whether the variable "Vcap" is set to "Hi" or "Low". Vcap is represented by terminal 10 of U1 in FIG. 8. If "Vcap" is "Hi", then method 1200 proceeds to step 1235. If "Vcap" is "Low", then method 1200 proceeds to step 1237, where the variable "Sfault" is set to "No". Namely, Vcap is a measure of the voltage of the storage capacitor C4 at a particular time. In step 1232, method 1200 presumes that a flash has just occurred. As such, at this point in time, Vcap under normal condition should reflect a low voltage, whereas a Vcap with a high voltage indicates that a fault has occurred.

In step 1235, method 1200 sets several functions or variables. First, "Sfault" is set to "Yes", since it is presumed that a fault has occurred where Vcap is "High" after a flash. Second, the function "SKIP" is set to "Off", which allows the alarm unit to stimulate a flash as frequently as possible, in light of the detected fault condition. Third, "Sosc" is turned "Off"to avoid an overcharging condition, since it has been detected that Vcap is still "High" after a flash. Finally, the counter "Vcount" is set equal to "Vref"+1, thereby ensuring that the SKIP function will remain off.

In step 1240, method 1200 queries whether the function, "SKIP", is set to "On". If the query is affirmatively answered, then method 1200 proceeds to step 1242, where the variable "SKflash" is toggled. If the query is negatively answered, then method 1200 proceeds to step 1245, where the variable "SKflash" is set to "Off".

In step 1247, method 1200 queries whether the function, "SKIP", is set to "On". If the query is affirmatively answered, then method 1200 proceeds to step 1250. If the query is negatively answered, then method 1200 proceeds to step 1252.

In step 1250, method 1200 queries whether the audio frequency is sweeping "up". If the query is affirmatively answered, then method 1200 proceeds to step 1252. If the query is negatively answered, then method 1200 proceeds to step 1255.

In step 1252, method 1200 resets "RTCC" and "AFcount" to zero and turns off "SoscSD".

In step 1255, method 1200 queries whether the function "SILENCE" is set to "Off"and the function "Code 3" is set to "On". If the query is affirmatively answered, then method 1200 proceeds to step 1257. Namely, the Code 3 horn signal pattern has been previously selected and method 1200 will now maintain the predefined audio pattern. If the query is negatively answered, then method 1200 proceeds to step 1272.

In step 1257, method 1200 queries whether "Sytimer" is equal to 0.5 second. If the query is affirmatively answered, then method 1200 decrements a counter "C3count" in step 1260. The counter "C3count" is employed to produce the Code 3 audio pattern. If the query is negatively answered, then method 1200 proceeds to step 1272.

In step 1262, method 1200 queries whether the counter "C3count" is equal to zero (0). Namely, method 1200 is checking whether the end of the Code 3 pattern has been reached. If the query is affirmatively answered, then method 1200 resets the counter "C3count" to a value of four (4) in step 1265. If the query is negatively answered, then method 1200 proceeds to step 1267.

In step 1267, method 1200 queries whether the counter "C3count" is greater than one (1). If the query is affirmatively answered, then method 1200 sets the function "MUTE" to "Off"in step 1270 in preparation to sound the horn. If the query is negatively answered, then method 1200 proceeds to step 1272.

Figure 15:
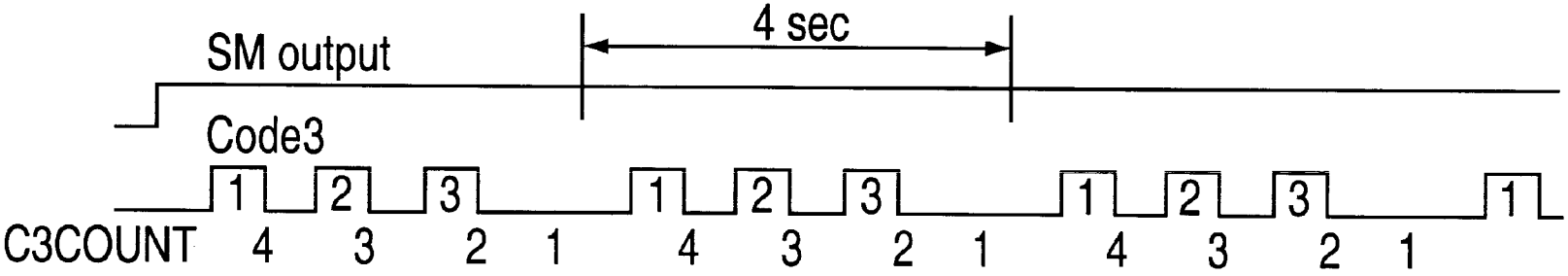
FIG. 15 is a diagram showing the relationship between the system sync signal and the audio alarm signal of one embodiment of the present invention.

The relationship between the counter "C3count", the sync pulses and the audio Code 3 horn signal is shown in FIG. 15.

Each reference synchronization pulse triggers a set of three (3) one-half second of silence followed by a one-half second horn blast, and one (1) one and one-half second of silence.

In step 1272, method 1200 increments "Sytimer", which tracks the elapsed time from strobe flash to strobe flash. Since Control Program NO. 2 is executed at the end of a sweep up or sweep down cycle, each increment of "Sytimer" represents a particular time duration, e.g., 0.0083 second.

In step 1275, method 1200 queries whether the "Mode" is set to "Sync" and the counter "C3count" is set to "One" (1). If the query is affirmatively answered, then method 1200 proceeds to step 1277. If the query is negatively answered, then method 1200 proceeds to step 1282.

In step 1277, method 1200 queries whether "SYtimer" is less than "SYlimit". If the query is affirmatively answered, then method 1200 proceeds to step 1299. If the query is negatively answered, then method 1200 proceeds to step 1280, where "Mode" is set to "Auto". Namely, method 1200 compares "SYtimer" to a predetermined maximum time, "Sylimit", in which case, method 1200 expects a sync pulse to arrive relative to the previous strobe flash. "Sylimit" can be set equal to 1.1 seconds in one embodiment. As such, if "SYtimer" is not less than "SYlimit", then there is a problem with the sync pulses and the operating mode of the alarm unit is switched to "Auto".

In step 1282, method 1200 queries whether "SYtimer" is equal to "SYflash". "SYflash" is a preset value that indicates a time in which the alarm unit should flash, e.g., once every second after the reception of a reference synchronization pulse. It should be understood that "SYflash" can be modified to a different time duration in accordance with a particular application. If the query in step 1282 is affirmatively answered, then method 1200 proceeds to step 1285 where "SYtimer" is reset to Zero (0) and "Flash" is set "On". Namely, it is time to trigger a flash. If the query is negatively answered, then method 1200 proceeds to step 1299. Namely, insufficient time has elapsed to trigger a flash.

In step 1287, method 1200 queries whether "Sfault" is set to "Yes". If the query is affirmatively answered, then method 1200 proceeds to step 1290 where SCR is turned "On". Namely, a fault has been previously detected. As such, method 1200 will turn SCR "On" as soon as possible regardless of other functions such as "SKIP". If the query is negatively answered, then method 1200 proceeds to step 1292.

In step 1292, method 1200 queries whether the function, "SKIP", is set to "Off". If the query is affirmatively answered, then method 1200 proceeds to step 1297 where SCR is turned "On". If the query is negatively answered, then method 1200 proceeds to step 1295.

In step 1295, method 1200 queries whether the variable or bit, "SKflash", is set to "On". If the query is affirmatively answered, then method 1200 proceeds to step 1299. If the query is negatively answered, then method 1200 proceeds to step 1297 where SCR is turned "On". In step 1299, method 1200 ends and returns to method 1000 to step 1025.

Figure 14:
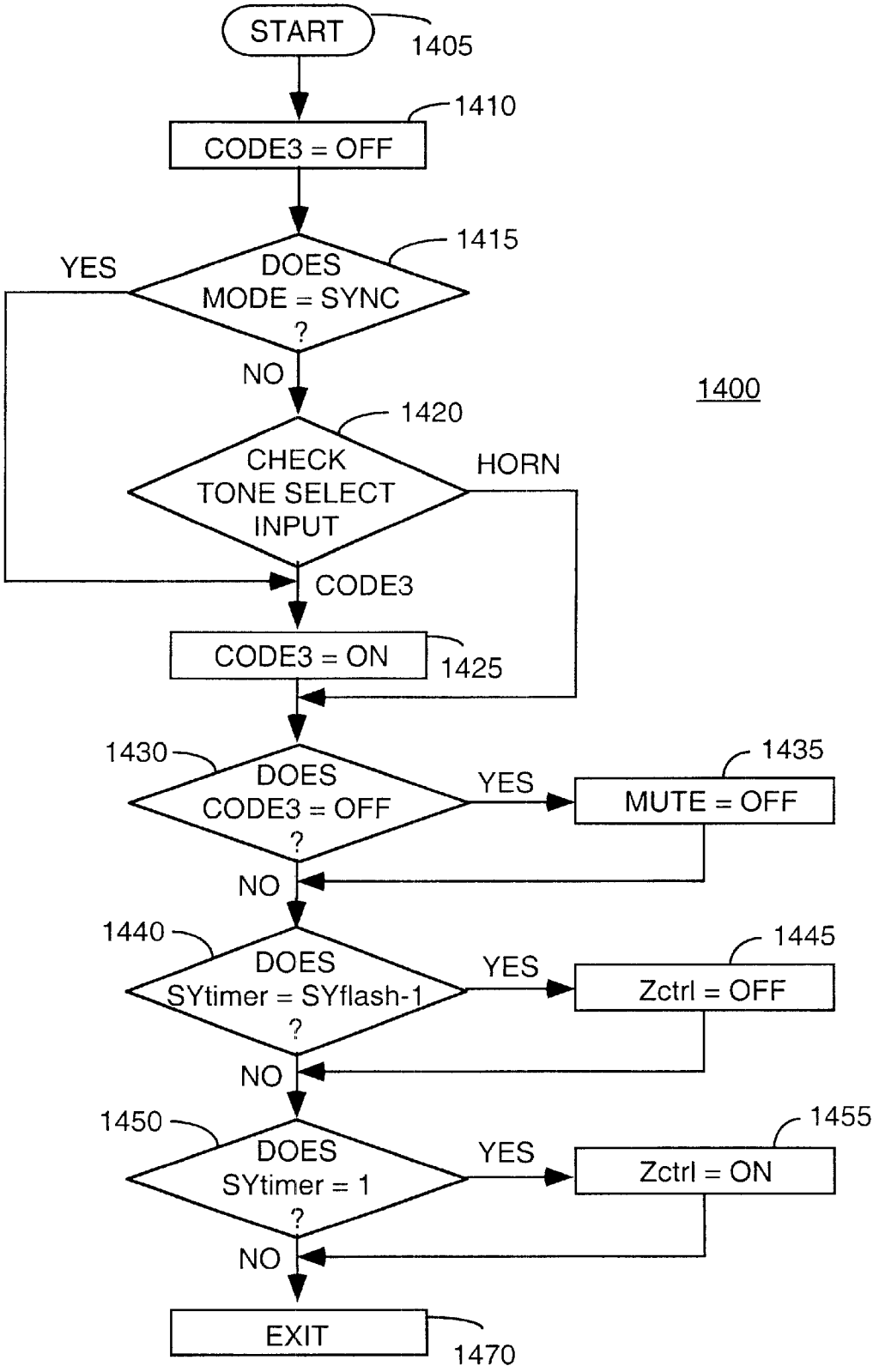
FIG. 14 illustrates a flowchart of Control Program No. 3 of FIG. 10.
Figure 16:
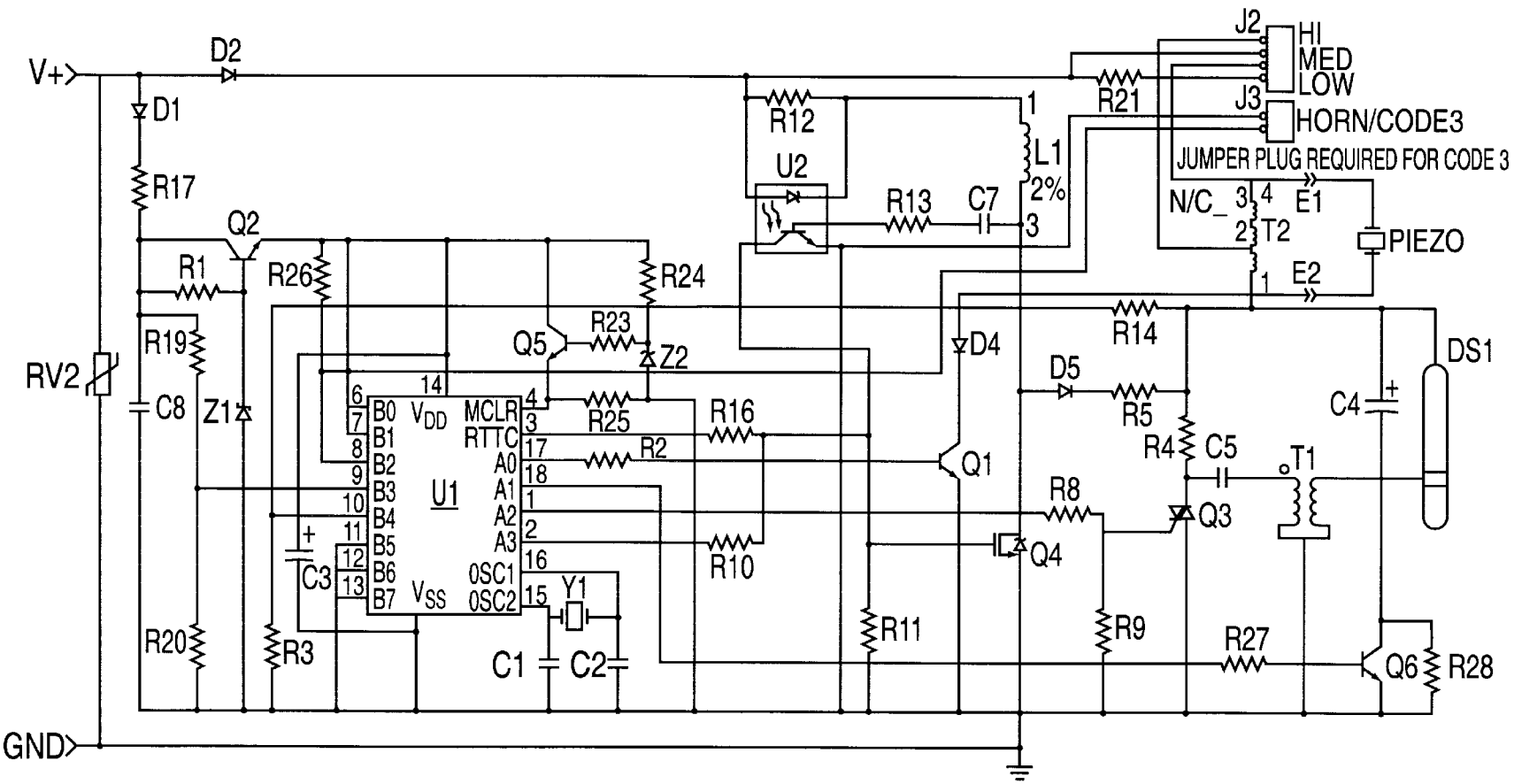
FIG. 16 is a circuit diagram of another embodiment of an alarm unit employed in the present invention.

FIG. 14 illustrates a flowchart of Control Program No. 3 (step 1073) of FIG. 10. Namely, FIG. 14 illustrates a method 1400 for detecting the selection of the Code 3 audio pattern or a continuous tone audio pattern in the alarm unit, e.g., as shown in FIG. 16 below, by means of a jumper setting.

More specifically, method 1400 starts in step 1405 and proceeds to step 1410, where method 1400 sets "Code 3" equal to "Off".

In step 1415, method 1400 queries whether the function "Mode" is set to "Sync". If the query is affirmatively answered, then method 1400 proceeds to step 1425, where "Code 3" is set to "On". Namely, in one embodiment, it is optionally presumed that a Code 3 audio pattern is desired if the alarm units are operated under synchronization mode. If the query is negatively answered, then method 1400 proceeds to step 1420.

In step 1420, method 1400 checks the tone select input jumper on the alarm unit to determine the selected audio pattern. If a continuous tone is selected with the jumper, method 1400 simply proceeds to step 1430, since "Code 3" was previously set to "Off"in step 1410. If a Code 3 tone is selected with the jumper, method 1400 proceeds to step 1425, where "Code 3" is set to "On".

In step 1430, method 1400 queries whether the "Code 3" is set to "Off". If the query is affirmatively answered, then method 1400 proceeds to step 1435, where the function "MUTE" is set to "Off". If the query is negatively answered, then method 1400 proceeds to step 1440.

In step 1440, method 1400 queries whether the "SYtimer" is equal to "SYflash"−1. If the query is affirmatively answered, then method 1400 proceeds to step 1445, where the function "Zictrl" is set to "Off". If the query is negatively answered, then method 1400 proceeds to step 1450.

In step 1450, method 1400 queries whether the "SYtimer" is equal to the value "One" (1). If the query is affirmatively answered, then method 1400 proceeds to step 1455, where the function "Zictrl" is set to "On". If the query is negatively answered, then method 1400 ends in step 1470.

It should be noted that optional steps 1440–1455 provide dynamic control of the inrush limiting circuit as shown in FIG. 8. As such, steps 1440–1455 can be omitted if the inrush limiting circuit is left "On" after initialization as shown in step 1020.

Figure 13A:
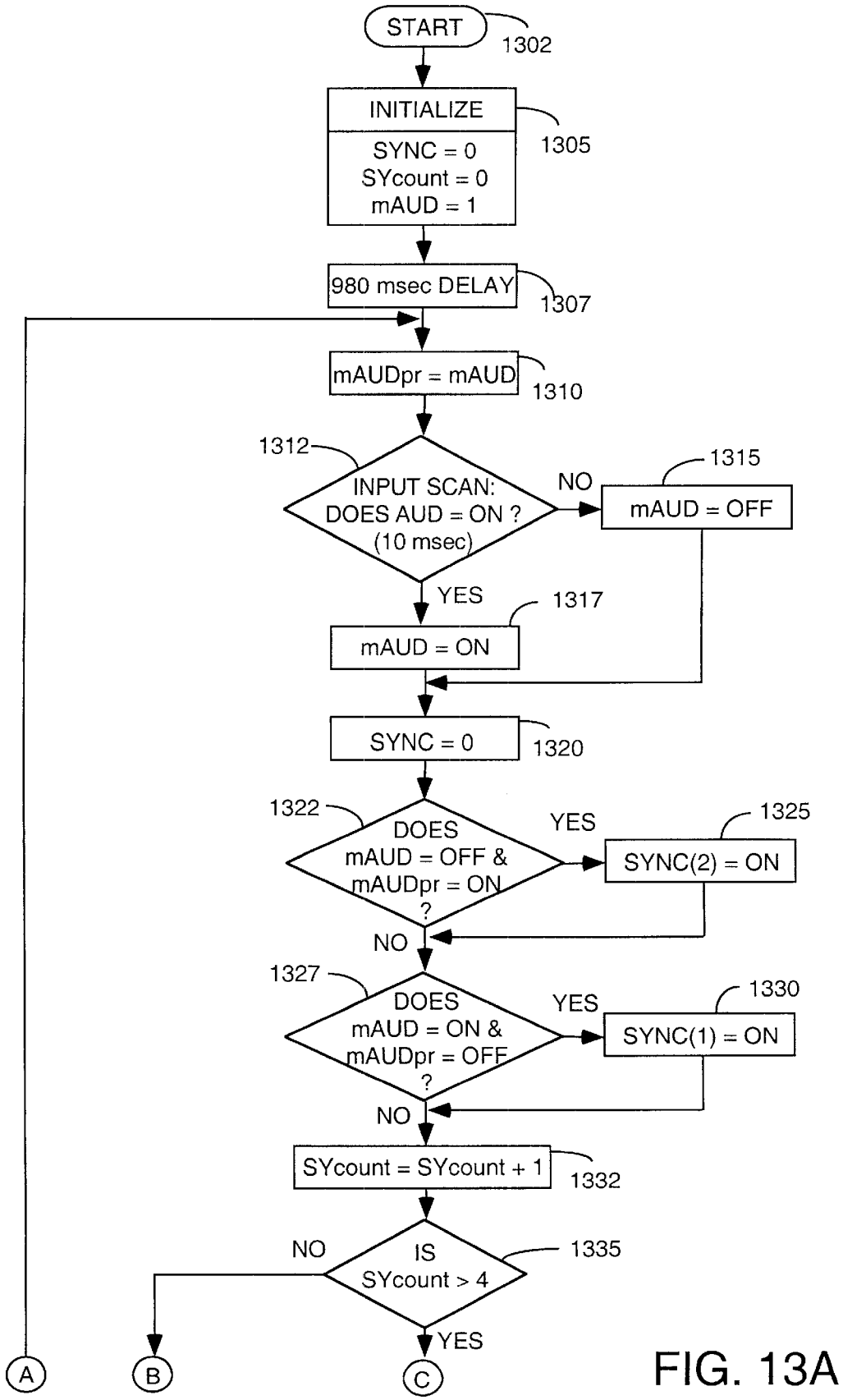
Figure 13B:
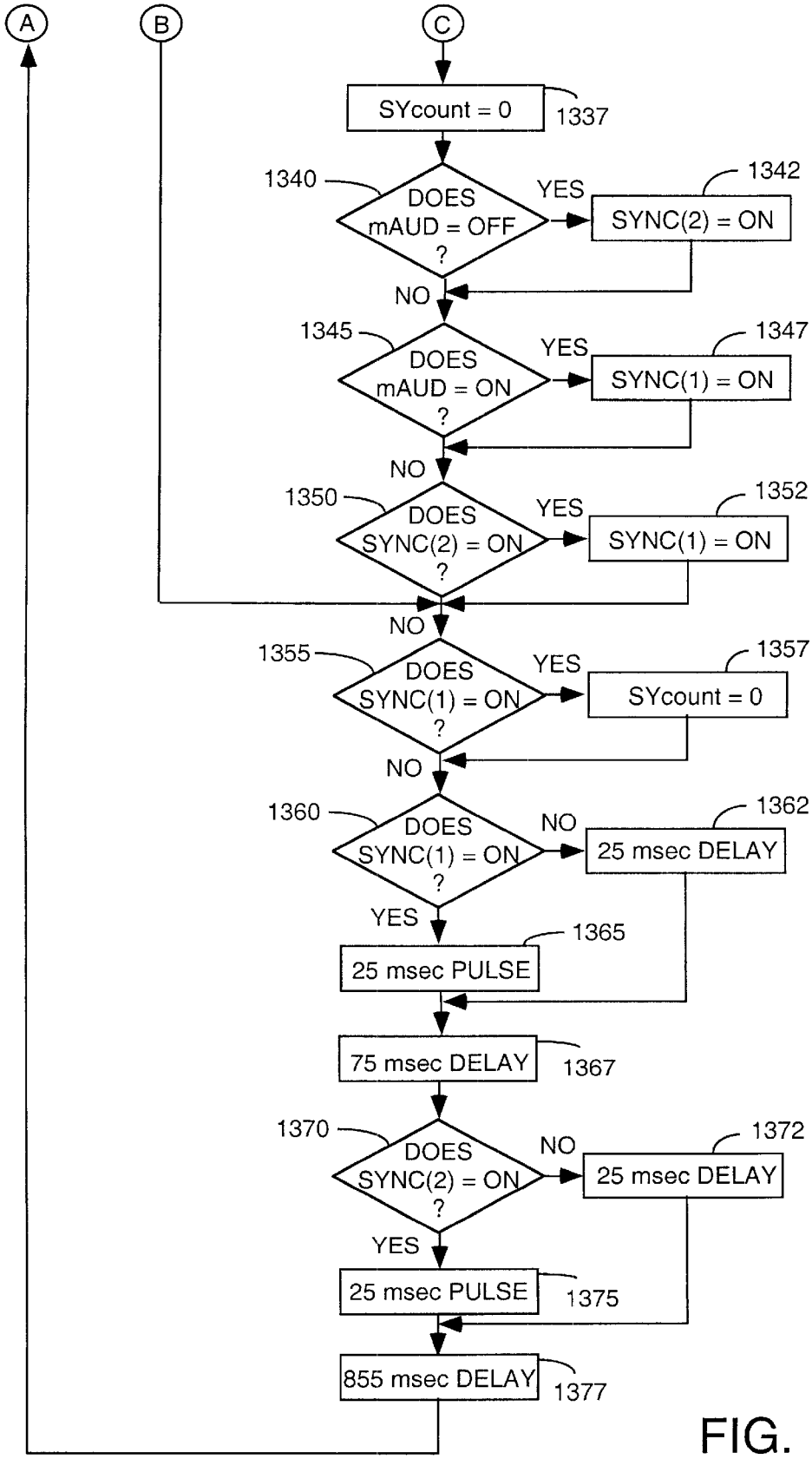

FIG. 13, FIG. 13A, and FIG. 13B illustrate a flowchart of an alternate embodiment of a software routine or method of the microcontroller of the interface control circuit as shown in FIG. 5. More specifically, method 1300 starts in step 1302 and proceeds to step 1305 where initialization is performed, e.g., one or more registers and variables are initialized, e.g., "SYNC" is set equal to "0", "SYcount" is set equal to "0" and "mAUD" is set equal to "1".

In step 1307, method 1300 employs a delay where for a short period of time, e.g., 980 msec., the interface control circuit will not generate any reference signal.

In step 1310, method 1300 sets the variable "mAUDpr" (e.g., a single bit) equal to "mAUD", where "mAUD" represents a memorized setting of the audible input terminal (secondary loop 48) on the interface control circuit and "mAUDpr" represents a previous "mAUD" setting. The audible input terminal is employed to indicate to the interface control circuit whether the "SILENCE" feature is activated for a loop of alarm units. If a voltage is present at the audible input terminal (e.g., AUD=1 or ON), then the "SILENCE" feature is not activated. If a voltage is absent or reversed at the audible input terminal (e.g., AUD=0 or OFF), then the "SILENCE" feature is activated.

In step 1312, method 1300 queries by actually scanning the audible input terminal to determine whether the "SILENCE" feature is activated (ON or OFF). If the "SILENCE" feature is activated, then method 1300 stores that setting in step 1315 by setting "mAUD" equal to Off. If the "SILENCE" feature is not activated, then method 1300 stores that setting in step 1317 by setting "mAUD" equal to On.

In step 1320, method 1300 sets the variable SYNC equal to "0", clearing SYNC(1) and SYNC(2).

In step 1322, method 1300 queries whether "mAUD" equals to OFF and "mAUDpr" equals to ON, i.e., whether a transition occurred. If the query is affirmatively answered then "SYNC(2)" is set equal to "ON" in step 1325. "SYNC (2)=ON" represents that a second pulse will be sent after a first pulse by the interface control circuit to effect the "SILENCE" feature. As discussed above, when a second pulse is sent at approximately 0.1 second from a first pulse, the alarm unit will interpret the second pulse as a command to implement the "SILENCE" feature. If the query at step 1322 is negatively answered, then method 1300 proceeds to step 1327.

In step 1327, method 1300 queries whether "mAUD" equals to ON and "mAUDpr" equals to OFF, i.e., again whether a transition occurred. If the query is affirmatively answered then "SYNC(1)" is set equal to "ON" in step 1330. "SYNC(1)=ON" represents that a first pulse will be sent by the interface control circuit. If the query at step 1327 is negatively answered then method 1300 proceeds to step 1332.

In step 1332, method 1300 increments a counter, "SYcount" by one. More specifically, the "Sycount" counter is used to count the number of predefined "cycles" that must occur prior to the transmission of a reference synchronization pulse. Each cycle can be perceived as representing the execution of method 1300 through one loop. In the present invention, if each cycle represents one second, then a reference synchronization pulse is sent after every four cycles or every four seconds. However, it should be understood that the predefined number of cycles can be adjusted in accordance with a particular implementation. For example, if the oscillator employed on the alarm unit is very precise, then the predefined number of cycles can be increased to further decrease the number of transmitted synchronization pulses, whereas if the oscillator employed on the alarm unit is not very precise, then the predefined number of cycles can be decreased to ensure synchronization.

In step 1335, method 1300 queries whether "Sycount" is greater than a value of four (4). If the query is affirmatively answered then method 1300 resets the "Sycount" counter back to zero in step 1337. Namely, a four second cycle is completed and the counter is reset to zero to start another four second cycle. If the query is negatively answered then method 1300 proceeds to step 1355.

In step 1340, method 1300 queries whether "mAUD" is equal to "OFF". If the query is affirmatively answered, then "SYNC(2)" is set equal to "ON" in step 1342. If the query at step 1340 is negatively answered, then method 1300 proceeds to step 1345.

In step 1345, method 1300 queries whether "mAUD" equals to "ON". If the query is affirmatively answered then "SYNC(1)" is set equal to "ON" in step 1347. If the query at step 1345 is negatively answered, then method 1300 proceeds to step 1350. It should be noted that steps 1340 and 1345 allow the interface control circuit to check at the beginning of each four second cycle whether the "SILENCE" feature is activated. In contrast, the above steps 1322 and 1327 allow the alarm panel to have the option of activating the "SILENCE" feature during the four second cycle, without having to wait for the four second cycle to be completed.

In step 1350, method 1300 queries whether "SYNC(2)" equals to "ON". If the query is affirmatively answered then "SYNC(1)" is set equal to "ON" in step 1352. Namely, in order to generate the second pulse (represented by having "SYNC(2)" equals to "ON") of a "double pulse", it is necessary to first generate the first pulse (represented by having "SYNC(1)" equals to "ON"). If the query at step 1350 is negatively answered, then method 1300 proceeds to step 1355.

In step 1355, method 1300 queries whether "SYNC(1)" equals to "ON". If the query is affirmatively answered, then method 1300 resets the "Sycount" counter back to zero in step 1357. Namely, step 1355 allows the interface control circuit to quickly respond to state transition of mAUD, e.g., in steps 1322 and 1327. For example, if the "SILENCE" feature is deactivated and a Code 3 audio pattern is desired immediately, then it is necessary to reset the "Sycount" counter back to zero in step 1357, so that the Code 3 audio pattern can start as soon as possible, i.e., within the next loop of method 1300, e.g., approximately one second. If the query at step 1350 is negatively answered, then method 1300 proceeds to step 1360.

In step 1355, method 1300 queries whether "SYNC(1)" equals to "ON". If the query is affirmatively answered, then method 1300 generates a reference synchronization pulse of a particular duration (typically between 10–30 msec.), e.g., a 25 msec. pulse in step 1365. If the query at step 1355 is negatively answered, then method 1300 proceeds to step 1362 where a delay is generated, e.g., a delay of 25 msec.

In step 1367, method 1300 generates a second delay, e.g., a delay of 75 msec. This delay is selected such that the time between the two pulses of a double pulse is 100 msec (25 msec. for the reference synchronization pulse and 75 msec. for the delay). It should be understood that the spacing of 100 msec. can be adjusted in accordance with a particular implementation.

In step 1370, method 1300 queries whether "SYNC(2)" equals to "ON". If the query is affirmatively answered, then method 1300 generates a second pulse of a particular duration (typically between 10–30 msec.), e.g., a 25 msec. pulse in step 1375. If the query at step 1370 is negatively answered, then method 1300 proceeds to step 1372 where a delay is generated, e.g., a delay of 25 msec.

In step 1377, method 1300 generates a third delay, e.g., a delay of 855 msec. This delay is selected such that the time for executing the loop of method 1300 is approximately one second (0.10 msec.+0.25 msec.+0.75 msec.+0.25 msec.+ 0.855 msec.=0.990 msec.). In turn, method 1300 returns to step 1310 where the loop of method 1300 is repeated.

FIG. 16 illustrates a circuit diagram of another embodiment of an alarm unit 1600 employed in the present invention. Namely, alarm unit 1600 shows a "Tone Select Input" jumper J3. The setting of this jumper can be detected in the above Control Program No. 3 as shown in FIG. 14, and is used to determine if a Code 3 horn or a continuous horn is to be generated.

More specifically, resistor R26 pulls pin 8 of microcontroller U1 "High" when jumper J3 is removed indicating the continuous horn setting. When jumper J3 is installed, pin 8 is forced "Low" indicating Code 3 horn setting.

FIG. 16 also shows another method of providing the "MED" volume level. The entire winding of transformer T2 is connected to the cathode of diode D2. The additional inductance reduces the volume level from "HI" to "MED". This method eliminates the need for a second resistor (R22) as shown in FIG. 8. The balance of FIG. 16 is essentially the same as FIG. 8.

By way of example, the circuit shown in FIG. 16 may use the following parameters to obtain the above-described switching cycle:

| ELEMENT | VALUE OR NUMBER |
|---|---|
| T1, DS1 | FLASHTUBE, TRIGGER COIL ASSEMBLY |
| C1, C2 | CAP 33 pF 5% 50 V |
| C3 | CAP 68 uF 10% 6.3 V |
| C4 | CAP 33 uf 10% 250 V |
| C5 | CAP .047 uF 5% 400 V |
| C7 | CAP 33 pF 5% 200 V |
| C8 | CAP .10 uF 20% 100 V |
| D1, D2 | DIODE, 1N4004 |
| D4, D5 | DIODE, HER105/UF4005 |
| J1 | CONN, MALE 2 P |
| J2 | HDR, R/A 4 P |
| J3 | HDR, R/A 2 P |
| L1 | IND ASY, 9.40 mH |
| Q1 | TRANSISTOR, 2TX455 |
| Q2 | TRANSISTOR, 2N5551 |
| Q3 | TRIAC, LOGIC L401E5 |
| Q4 | TRANSISTOR, IRF710 |
| Q5 | TRANSISTOR, 2N2907 |
| Q6 | TRANSISTOR, MPSA27 |
| R2 | RES ¼ W 560 OHMS 5% |
| R3 | RES ¼ W 12.1 K OHMS 1% |
| R4 | RES ¼ W 220 K OHMS 5% |
| R5 | RES ½ W 27 OHMS 5% |
| R8, R10 | RES ¼ W 1.0 K OHMS 5% |
| R1, R9, R16, R23, R26, R27 | RES ¼ W 10 K OHMS 5% |
| R11, R14 | RES ¼ W 1 M OHM 5% |
| R12 | RES ¼ W 9.31 OHMS 1% |
| R13 | RES ¼ W 100 K OHMS 5% |
| R17 | RES ½ W 330 OHMS 5% |
| R19 | RES ¼ W 10 K OHMS 1% |
| R20 | RES ¼ W 2.21 K OHMS 1% |
| R21 | RES ½ W 680 OHMS 5% |
| R24 | RES ¼ W 6.8 K OHMS 5% |
| R25 | RES ¼ W 39 K OHMS 5% |
| R28 | RES ½ W 220 OHMS 5% |
| RV1 | VARISTOR, 40 VAC/56 VDC |
| T2 | TRANSFORMER |
| U1 | MICROCONTROLLER, PIC16C54 |
| U2 | OPTO-COUPLER, 4N35 |
| W1, W2, W3, W4 | JMPR, WIRE |
| Y1 | CERA RESN, 4.00 Mhz |
| Z1 | ZNR DIODE, 1N4626 5% .4 W |
| Z2 | ZNR DIODE, 1N4619 3.0 V 5 |

Although various embodiments which incorporate the teachings of the present invention have been shown and described in detail herein, those skilled in the art can readily devise many other varied embodiments that still incorporate these teachings.

What is claimed is:

1. A method for synchronizing a plurality of alarm units, said method comprising the steps of:

a) sending a reference synchronization signal to at least one of the plurality of alarm units;

b) synchronizing a local counter reference of said alarm unit to said reference synchronization signal; and c) activating said alarm unit selectively to flash at a flash rate greater than or equal to a transmission rate of the reference synchronization signal to each of said alarm units in accordance with said local counter reference.

2. The method of claim 1, further comprising the step of:

d) activating said alarm unit independently if said reference synchronization signal is not received by said alarm unit.

3. An apparatus for synchronizing a plurality of alarm units, said apparatus comprising:

a sending means for sending a reference synchronization signal to at least one of the plurality of alarm units;

a synchronizing means for synchronizing a local counter reference of said alarm unit to said reference synchronization signal;

an activating means for activating said alarm unit in accordance with said local counter reference, wherein said activating means activates said alarm unit selectively to flash at a flash rate greater than or equal to a transmission rate of the reference synchronization signal to said alarm unit.

4. The apparatus of claim 3, wherein said activating means activates said alarm unit independently if said reference synchronization signal is not received by said alarm unit.

5. A computer-readable medium having stored thereon a plurality of instructions, the plurality of instructions including instructions which, when executed by a processor, cause the processor to perform the steps comprising of:

a) sending a reference synchronization signal to at least one of the plurality of alarm units;

b) synchronizing a local counter reference of said alarm unit to said reference synchronization signal; and c) activating said alarm unit selectively to flash at a flash rate greater than or equal to a transmission rate of the reference synchronization signal to each of said alarm units in accordance with said local counter reference.

6. The computer-readable medium of claim 5, further comprising the step of:

d) activating said alarm unit independently if said reference synchronization signal is not received by said alarm unit.

7. An alarm unit, comprising:

a receiving means for receiving a reference synchronization signal from an interface control circuit;

a synchronizing means for synchronizing a local counter reference of the alarm unit to said reference synchronization signal; and an activating means for activating a flashtube of the alarm unit in accordance with said local counter reference, wherein said activating means activates said alarm unit selectively to flash at a flash rate greater than or equal to a transmission rate of the reference synchronization signal to said alarm unit.

8. The alarm unit of claim 7, wherein said activating means activates said alarm unit independently if said reference synchronization signal is not received by said alarm unit.

* * * * *